US009265394B2

(12) United States Patent
Van Der Kooi et al.

(10) Patent No.: US 9,265,394 B2
(45) Date of Patent: Feb. 23, 2016

(54) NOZZLE ARRANGEMENT WITH BRUSH AND SQUEEGEE

(71) Applicant: KONINKLIJKE PHILIPS N.V., Eindhoven (NL)

(72) Inventors: Johannes Tseard Van Der Kooi, Eindhoven (NL); Matthijs Hendrikus Lubbers, Eindhoven (NL); Sepas Setayesh, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/432,588

(22) PCT Filed: Feb. 4, 2014

(86) PCT No.: PCT/EP2014/052120

§ 371 (c)(1),
(2) Date: Mar. 31, 2015

(87) PCT Pub. No.: WO2014/122114

PCT Pub. Date: Aug. 14, 2014

(65) Prior Publication Data

US 2015/0250367 A1 Sep. 10, 2015

(30) Foreign Application Priority Data

Feb. 5, 2013 (EP) ..... 13153945

(51) Int. Cl.

| | |
|---|---|
| ***A47L 11/00*** | (2006.01) |
| ***A47L 9/04*** | (2006.01) |
| ***A47L 9/06*** | (2006.01) |
| ***A47L 11/40*** | (2006.01) |

(52) U.S. Cl.

CPC ..... *A47L 9/0477* (2013.01); *A47L 9/0606* (2013.01); *A47L 9/0626* (2013.01); *A47L 11/4041* (2013.01); *A47L 11/4044* (2013.01)

(58) Field of Classification Search

CPC ... A47L 9/0606; A47L 9/0626; A47L 9/0477; A47L 11/4041; A47L 11/4044

USPC ..... 15/320, 401, 98, 121

See application file for complete search history.

(56) References Cited

U.S. PATENT DOCUMENTS

| | | | |
|---|---|---|---|
| 4,817,233 | A | 4/1989 | Waldhauser |
| 4,864,682 | A | 9/1989 | Bewley, Jr. |

(Continued)

FOREIGN PATENT DOCUMENTS

| | | | |
|---|---|---|---|
| DE | 19718497 | A1 | 11/1998 |
| WO | 2010041184 | A1 | 4/2010 |

(Continued)

*Primary Examiner* — David Redding

(57) ABSTRACT

Nozzle arrangement (10) of a vacuum cleaning device (100) for cleaning a surface (20), comprising: —a nozzle housing (28); —a brush (12) rotatable about a brush axis (14), said brush (12) being provided with flexible microfiber brush elements (16) having tip portions (18) for contacting the surface to be cleaned (20) and picking up dirt and liquid particles (22, 24) from the surface to be cleaned (20) during the rotation of the brush (12); —a drive means for rotating the brush (12); —a single squeegee element (32) for wiping dirt and liquid particles (22, 24) across or off the surface to be cleaned (20) by contacting said surface (20) with its free end (33), wherein said squeegee element (32) extends along a longitudinal direction (48), which is arranged substantially parallel to the brush axis (14), and is attached with its fixed end (33) to the bottom side (30) of the nozzle housing (28) on a side of the brush (12) where the brush elements (16) enter the nozzle housing (28) during the rotation of the brush (12).

15 Claims, 8 Drawing Sheets

(56) References Cited

U.S. PATENT DOCUMENTS

| | | | |
|---|---|---|---|
| 5,212,848 | A | 5/1993 | Geyer |
| 5,221,828 | A | 6/1993 | Basheer |
| 2003/0028995 | A1 | 2/2003 | Ikeda |
| 2011/0302735 | A1 | 12/2011 | Santarsiero |

FOREIGN PATENT DOCUMENTS

| | | | |
|---|---|---|---|
| WO | 2013027140 | A1 | 2/2013 |
| WO | 2013027164 | A1 | 2/2013 |

(state of the art)

NOZZLE ARRANGEMENT WITH BRUSH AND SQUEEGEE

This application is the U.S. National Phase application under 35 U.S.C. §371 of International Application No. PCT/EP2014/052120, filed on Feb. 4, 2014, which claims the benefit of European Application No. 13153945.4 filed on Feb. 5, 2013. These applications are hereby incorporated by reference herein.

FIELD OF THE INVENTION

The present invention relates to a nozzle arrangement of a vacuum cleaning device for cleaning a surface. Further, the present invention relates to a vacuum cleaning device with such a nozzle arrangement.

BACKGROUND OF THE INVENTION

Hard floor cleaning these days is done by first vacuuming the floor, followed by mopping it. Vacuuming removes the coarse dirt, while mopping removes the stains. From the state of the art many appliances, especially targeting the professional cleaning sector, are known that claim to vacuum and mop in one go. Appliances for the professional cleaning sector are usually specialized for big areas and perfectly flat floors. They rely on hard brushes and suction power to get water and dirt from the floor. Appliances for home use often use a combination of a hard brush and a squeegee nozzle. Like the appliances for the professional cleaning sector these products use the brush to remove stains from the floor and the squeegee in combination with an under-pressure to lift the dirt from the floor.

Said squeegee elements are usually realized by a flexible rubber lip that is attached to the bottom of the cleaning device and merely glides over the surface to be cleaned thereby pushing or wiping dirt particles and liquid across or off the surface to be cleaned. An under-pressure, usually generated by a vacuum aggregate, is used to ingest the collected dirt particles and liquid.

A squeegee that may be used in cleaning systems is, for example, known from US 20030028995 A1. A vacuum cleaner of the prior art that uses a combination of a rotating brush and a squeegee is known from U.S. Pat. No. 4,864,682 A. This vacuum cleaner comprises a self-adjusting wiper strip assembly that automatically adjusts for the type of floor surface on which the vacuum cleaner is being used. The assembly used therein requires a high suction power in order to receive a satisfactory cleaning result. The brush which is used in this vacuum cleaner is an agitator (also denoted as adjutator) with stiff brush hairs to agitate the floor, e.g. a carpet. These stiff hairs show a rather good scrubbing effect, which enable to use the brush particularly for removing stains. However, the performance on drying the floor is rather low, since such an agitator is not able to lift liquid from the floor.

Vacuum and mop in one go devices known from the prior art often use brush elements that are actively sprayed with water or a cleaning rinse in order to improve the removal of stains. Such devices usually use a double squeegee element having two squeegees that are arranged on one side of the brush, as this is exemplarily shown in the attached FIG. 15. An additional vacuum source generates a suction in a channel between said double squeegee arrangement in order to remove the cleaning water from the floor again.

However, in order to remove the actively sprayed cleaning water from the floor again these devices always have to be moved in a forward direction in which the brush is, seen in the direction of the device movement, located in front of the double squeegee arrangement. Moving the device in an opposite backward direction would leave the floor wet, since the cleaning water, which is dispersed with the brush, is not removed by the squeegees in this backward stroke.

To get a good cleaning result in a forward as well as in a backward stroke of the device known cleaning devices are therefore provided with a double squeegee nozzle at both sides of the brush. U.S. Pat. No. 4,817,233 A shows a device of this type. Even though such double squeegee arrangements on both sides of the brush show good cleaning results, the nozzle of these devices become fairly bulky. This again results in a non-satisfying, limited work capability. Especially in household appliances where often narrow corners need to be cleaned, such bulky nozzles are, due to their limited liberty of action, uncomfortable to use.

Besides that, the use of double squeegee arrangements as shown in the attached FIG. 15 and in U.S. Pat. No. 4,817,233 A has several further disadvantages. Due to the constant contact of the squeegees with the floor during the movement of the device, such double squeegees may generate a high scratch load to the floor. Especially when the double squeegee arrangements are used on each side of the brush, this will lead to an increased risk of inducing scratches on the floor. Furthermore, such squeegee arrangements include the disadvantage that they are not open for coarse dirt like e.g. hairs or peanuts, since coarse dirt is often entangled within the squeegees or is pushed away from the squeegees, and is thus not able to enter the suction inlet. Apart from that such double squeegee nozzles are hard to clean and do not have the ability to clean themselves.

Independent of the type of wet cleaning device it is one of the major challenges to obtain a uniform cleaning behavior independent of the movement direction of the nozzle. Especially in single-brush-single-squeegee solutions of the prior art this is, however, not the case. If the nozzle is moved in the forward direction in which the brush is, seen in the direction of the device movement, located in front of the squeegee, the squeegee more or less wipes off all liquid from the floor. Hence, a good drying effect is achieved. If the nozzle is, however, moved in the opposite backward direction the floor is most of the times left wet, since the cleaning water, which is dispersed with the brush, is not removed from the squeegee in this backward stroke. For a single-brush-single-squeegee solution this results in the fact that a delicate balance between the drying performance of the rotating brush and the drying performance of the squeegee is required.

Besides this problem the squeegee itself needs to be extremely abrasion and chemically resistant to maintain the initial performance over the lifetime of the appliance.

U.S. Pat. No. 5,221,828 A discloses a heated wiper blade with a conductive elastomer body and a pair of electrodes along each side of the body.

Applicant's non-prepublished applications WO/2013/027140 and WO/2013/027164 describe cleaning devices comprising a brush and a squeegee element.

SUMMARY OF THE INVENTION

It is an object of the present invention to provide an improved nozzle arrangement for a cleaning device that shows, compared to the state of the art, an improved cleaning performance and has at the same time a nozzle of small size in order to guarantee a high liberty of action. It is particularly an object to provide a nozzle arrangement that shows a uniform cleaning behavior independent of the movement direction of the nozzle.

This object is achieved by a nozzle arrangement that comprises:

a nozzle housing;

a brush rotatable about a brush axis, said brush being provided with flexible microfiber brush elements having tip portions for contacting the surface to be cleaned and picking up dirt and liquid particles from the surface to be cleaned during the rotation of the brush, wherein the brush is at least partly surrounded by the nozzle housing and protrudes at least partly from a bottom side of said nozzle housing;

a drive means for rotating the brush;

a single squeegee element for wiping dirt and liquid particles across or off the surface to be cleaned by contacting said surface with its free end, wherein said squeegee element extends along a longitudinal direction, which is arranged substantially parallel to the brush axis, and is attached with its fixed end to the bottom side of the nozzle housing on a side of the brush where the brush elements enter the nozzle housing during the rotation of the brush, wherein the squeegee element comprises a synthetic material with a hardness between 25 and 60 Shore-A and a force-displacement-behavior of 0.02 N/mm<F/d<0.27 N/mm, wherein F is a force acting on the free end of the squeegee element perpendicular to the longitudinal direction and d is a displacement of said free end perpendicular to the longitudinal direction that is caused by the force F.

The above-mentioned object is furthermore, according to a second aspect of the present invention, achieved by a vacuum cleaning device for cleaning a surface, the vacuum cleaning device comprising:

the above-mentioned nozzle arrangement; and a vacuum aggregate for generating an under-pressure in a suction-area between the nozzle housing and the brush.

Preferred embodiments of the invention are defined in the dependent claims. The claimed vacuum cleaning device has similar and/or identical preferred embodiments as the claimed nozzle arrangement and as defined in the dependent claims.

Similar as proposed in WO 2010/041184 A1 the brush, which is used according to the present invention, is equipped with thin flexible microfiber bristles, which are herein generally denoted as flexible brush elements. Due to these flexible brush elements the brush is, in contrast to agitators with hard/stiff brush elements, able to not only pick up dirt particles, but also to pick up liquid.

In contrast to the solution provided in WO 2010041184 A1 only one single brush (not two counter-rotating brushes) is provided according to the present invention. In addition thereto the cleaning device according to the present invention is furthermore equipped with a single squeegee element, which may also be simply denoted as squeegee. Said squeegee element preferably comprises a flexible rubber lip that is configured to glide over the surface to be cleaned and thereby wipe dirt and/or liquid particles across or off the floor during a movement of the nozzle.

The squeegee element is preferably arranged on a side of the brush where the brush elements enter the nozzle housing during the rotation of the brush. The squeegee element is thus arranged on the side of the brush, where the dirt particles and liquid droplets are released from the brush. Due to the flexibility of the brush elements, the brush elements act as a kind of whip that smashes off the dirt and/or liquid particles as soon as they are during their rotation released from the surface to be cleaned. This relies on the fact that the flexible brush elements are bent or indented as soon as they come into contact with the surface to be cleaned and straighten out as soon as they loose contact from the floor. This principle will be explained in detail further below.

One of the central features of the present invention is the combination of:

a) a rotating brush that is, in contrast to agitators, able to lift dirt as well as water, and b) an squeegee that is especially adapted to the microfiber type brush.

After extensive research in laboratory and home environment the inventors have found and optimal solution for the material behavior and hardness of the squeegee. It has been found that a hardness of the squeegee material between 25 and 60 Shore-A in combination with a force-displacement-behavior of 0.02 N/mm<F/d<0.27 N/mm, even more preferably of 0.02 N/mm<F/d<0.13 N/mm, results in an optimal squeegee behavior during use.

It is to be noted that the above-mentioned parameter combination is neither random nor similar to parameters of squeegees known from the prior art. The idea behind the above-mentioned parameter combination is the provision of a squeegee that has a similar behavior as the rotating microfiber brush. A "similar behavior" in this case means that by wiping the floor with the squeegee, the same or almost the same amount of water remains on the floor as the microfiber brush leaves behind. In this case, the floor has the same or almost the same wetness independent of the movement direction of the nozzle. If the nozzle is moved in the forward direction, in which the brush is, seen in the direction of the nozzle movement, located in front of the squeegee, the squeegee wipes the floor, so that its behavior has a major effect on the amount of liquid that is left behind. If the nozzle is instead moved in the backward direction, in which the brush is, seen in the direction of the nozzle movement, located behind the squeegee, the behavior of the brush has a major influence on the amount of water that is left behind on the floor. If both behaviors, the behavior of the squeegee and the behavior of the brush, are with respect to the liquid pick-up performance comparable, it may be even in a single-brush-single squeegee device be accomplished that the floor has an equal wetness independent of the movement direction of the nozzle. The inventors have found that the above-mentioned parameter combination almost exactly enables such a behavior of the nozzle.

A further important advantage is that the above-mentioned feature combination for the squeegee enables to have a uniform wetness on the floor over the whole range (length) of the squeegee and an evenly distributed drying time of the remaining water. Compared to "regular" squeegees as they are used in prior art cleaning devices, the presented squeegee is adapted to leave more liquid left behind on the floor. This is made on purpose. Even though the microfiber brush is able to lift liquid as well as dirt particles, the amount of water that is left behind is, compared to a "regular" squeegee, a bit higher. To receive the same behavior in the forward as in the background stroke, the squeegee may thus have to leave a slightly larger amount of liquid on the floor than usual. On the other hand, it has been found that consumers prefer to have a slightly wetter floor instead of having a perfectly dry floor. First of all, this increases the credibility of a wet cleaning device. If the wet cleaning device leaves a perfectly dry floor behind, consumers often believe that the device is not working correctly. Secondly, a thin liquid film that is left behind the nozzle also serves as a visual feedback for the user, where he/she has already cleaned the floor and where not.

A further advantage of the above-mentioned squeegee parameters is the high abrasion resistance and chemical resistance that such a type of squeegee has shown in the experiments of the applicant. The above-mentioned force-displacement-behavior is furthermore important in order to have the desired switching/flexing behavior of the squeegee.

As this is known from prior art squeegees, the squeegee usually flexes around its longitudinal direction depending on the movement direction of the nozzle. Therefore, it has to deform on the moment of switching (the moment of changing the movement direction). If it did not deform, it would lift the nozzle or the whole appliance and the nozzle could leave a mark on the cleaned floor. This would of course be an undesired behavior. The above-mentioned force-displacement-behavior therefore also realizes the delicate balance between a too stiff and a too weak (too flexible) squeegee. A too stiff squeegee could cause scratches on the floor, whereas a too weak squeegee could leave a too high amount of liquid on the floor and could be apart from that mechanically too instable.

Switching/flexing the squeegee is preferably supported by arranging protrusions (so-called studs) at or near the free end of the squeegee. According to an embodiment of the present invention, the squeegee element comprises a flexible rubber lip between its fixed and its free end and a plurality of protrusions for flexing the flexible rubber lip around the longitudinal direction between an open and a closed position depending on a movement direction of the nozzle arrangement, wherein said protrusions are arranged near the free end of the squeegee element and protrude from a backside of the flexible rubber lip that faces away from the brush.

These protrusions force the rubber lip to flex in the open position, in which dirt and liquid particles can enter the nozzle arrangement through openings between the protrusions, the flexible rubber lip and the surface, when the nozzle arrangement is moved on the surface in a backward direction, in which the squeegee is, seen in the movement direction, located in front of the brush. On the other hand, the rubber lip is adapted to flex into the closed position, in which the rubber lip wipes dirt and liquid particles across or off the surface to be cleaned, when the nozzle arrangement is moved on the surface in a forward direction. In this forward direction the squeegee element is, seen in the movement direction of the nozzle, located behind the brush.

The ability to switch the squeegee from an open to a closed position depending on the movement direction of the nozzle arrangement enables a good cleaning result in the forward as well as in the backward stroke of the nozzle. The open configuration is in order to allow the dirt to enter when the squeegee approaches dirt and liquid particles on the floor before the brush. In the closed position the squeegee closes the gap to the floor, or in other words wipes or glides over the surface, when the brush approaches the dirt and liquid particles on the floor before the squeegee.

The above-mentioned protrusions (studs) are adapted to flex/bend the rubber lip and thereby at least partly lift the rubber lip from the surface, when the nozzle is moved on the surface in the backward direction. Due to this bending/lifting of the rubber lip in the backward stroke of the nozzle, coarse dirt may enter the nozzle in the backward stroke through the openings created between the rubber lip, the protrusions and the floor. It is evident that the lifting of the rubber lip and the creation of the mentioned openings somehow decrease the under-pressure within the nozzle housing that may be created by a vacuum aggregate (i.e. the absolute pressure within the nozzle housing increases thereby). This decreased under-pressure mainly relies on the fact that the openings create an air leakage through which air can enter the nozzle. This air leakage and the resulting under-pressure decrease should not be too high, since this would result in a significantly different flow rate of air entering the nozzle in the forward stroke compared to the backward stroke.

The size of the protrusions (studs) is thus limited. The studs need to be on the other hand large enough to create large enough openings through which also coarse dirt may enter the nozzle. The size of the studs further depends on the distance between the brush and the squeegee and the minimum angle the dirt is propelled from the brush. Too large openings would allow dirt and liquid particles that are encountered by the brush to be launched out of the nozzle housing (through the openings) again. This would of course limit the performance of the device, as dirt would shoot out under the squeegee in the open position. It is thus evident that the size of the protrusions (studs) depends on a lot of parameters.

In a preferred embodiment of the present invention, a distance between a front end of the protrusions that faces away from the rubber lip and the back side of the rubber lip is between 0.5 and 4 mm. A most preferred size has been found to be around or equal to 1.8 mm.

The distance between the protrusions is important as well. If the protrusions are too close together, large dirt particles may not enter the nozzle. If the distance between two offset protrusions is on the other hand too large, the flexible rubber lip could deform and close the intended openings.

According to a preferred embodiment of the present invention, a distance between two offset protrusions is between 5 and 15 mm. The inventors have found an ideal distance that is in the range or equal to 12.5 mm combined with a size of each protrusion (distance between front end of the protrusion and back side of the rubber lip) of around or equal to 2.5 mm.

A further improvement may be achieved if at least one of the protrusions comprises at least one tapered face and rounded edges. This decreases the risk that coarse dirt like hairs gets entangled at or around the protrusions.

In the last paragraphs it has been mainly focused on the geometry, size and features of the protrusions of the squeegee element. However, even more important is the geometry and size of the rubber lip of the squeegee element.

As it has been pointed out in the first paragraphs of the summary of the invention, the behavior of the squeegee element and its rubber lip is especially important in order to guarantee a similar behavior as the brush, so that the performance of the device is similar or even the same in a forward as well as in a backward stroke of the nozzle. It has been pointed out that the rubber lip of the squeegee element is made of a synthetic material with a hardness between 25 and 60 Shore-A in combination with a force-displacement-behavior of $0.02\ N/mm<F/d<0.3\ N/mm$. Even more preferable is a hardness of 35 Shore-A in combination with a force-displacement-behavior of $0.02\ N/mm<F/d<0.15\ N/mm$. These requirements also have a significant influence on the dimensions of the rubber lip. Vice versa, the dimensions of the rubber lip also influence the force-displacement-behavior. A preferred material for the flexible rubber lip has been found to be polyurethane. Polyurethane has shown to be advantageous, since it does not produce a disturbing squeaking sound like state of the art squeegees normally produce. Apart from that, a squeegee made of polyurethane produces enough friction on the floor, which is needed for the above-mentioned flexing behavior of the squeegee.

In a preferred embodiment of the present invention the flexible rubber lip has a thickness of 0.5 to 3 mm. Most preferable is a thickness around or equal to 0.85 mm. The cross section of the flexible rubber lip may also be slightly tapered, e.g. from 0.85 mm at the thinnest point to 1 mm at the thickest point. It is clear that the thickness of the flexible rubber lip also depends on the chosen hardness. If a material with a lower hardness is chosen, e.g. with 25 Shore-A, the rubber lip should be thicker, e.g. have a thickness of 3 mm. On the other hand, if a material with an increased hardness is chosen, e.g. with 60 Shore-A, the thickness of the rubber lip should be comparably smaller, e.g. around 2 mm or less.

A further significant parameter is the height of the flexible rubber lip. According to a preferred embodiment of the present invention, the flexible rubber lip has a height, measured between the free end and the fixed end, of 5 to 20 mm. Again, the height of the rubber lip also depends on its thickness, and vice versa. To reach the above-mentioned requirements for the force-displacement-behavior, a larger height should also be combined with a larger thickness and a smaller height should be combined with a smaller thickness. An ideal height of the rubber lip has been found to be around or equal to 8.5 mm.

It shall, however, be pointed out again that the above-mentioned dimensions are related with each other. The most suitable option is of course a result of the implementation into the appliance. An optimum combination that has been found by the inventors is as follows:

a) height for the rubber lip: 8.5 mm,
b) thickness of the rubber lip: 0.85 mm,
c) hardness of the rubber lip material: 35 Shore-A,
d) size of the protrusions: 1.8 mm, and
e) material of the rubber lip: polyurethane.

It shall be also pointed out again that the properties and features of the squeegee are especially adapted to the type of brush that is used according to the present invention. In the following, the specific properties of the brush, which enable the brush to pick up dirt and/or liquid particles at the same time (in contrast to an agitator), will be explained in detail.

According to a preferred embodiment of the present invention the linear mass density of a plurality of the brush elements is, at least at the tip portions, lower than 150 g/10 km, preferably lower than 20 g/10 km.

In contrast to brushes often used according to the prior art, which are only used for stain removal (agitators), a soft brush with flexible brush elements as presented here also has the ability to pick-up water from the floor. Due to the flexible micro fiber hairs that are preferably used as brush elements, dirt particles and liquid can be picked up from the floor when the brush elements/microfiber hairs contact the floor during the rotation of the brush. The ability to also pick-up water with a brush is mainly caused by capillary and/or other adhesive forces that occur due to the chosen linear mass density of the brush elements. The very thin microfiber hairs furthermore make the brush open for coarse dirt. The microfiber hairs also have the advantage that the hairs serve as a flow restriction. Stiff hairs of an adjutator could instead not do so.

It is to be noted that the linear mass density as mentioned, i.e. the linear mass density in gram per 10 km, is also denoted as Dtex value. A very low Dtex value of the above-mentioned kind ensures that, at least at the tip portions, the brush elements are flexible enough to undergo a bending effect and are able to pick-up dirt particles and liquid droplets from the surface to be cleaned. Furthermore, the extent of wear and tear of the brush elements appears to be acceptable within this linear mass density range.

The experiments carried out by the applicant have proven that a Dtex value in the above-mentioned range appears to be technically possible and that good cleaning results can be obtained therewith. However, it has shown that cleaning results can be further improved by applying brush elements with an even lower upper limit of the Dtex value, such as a Dtex value of 125, 50, 20 or even 5 (in g/10 km).

According to a further preferred embodiment of the present invention the drive means are adapted to realize a centrifugal acceleration at the tip portions of the brush elements which is, in particular during a dirt release period when the brush elements are free from contact to the surface during rotation of the brush, at least 3,000 $m/s^2$, more preferably at least 7,000 $m/s^2$, and most preferably 12,000 $m/s^2$.

It is to be noted that the minimum value of 3,000 $m/s^2$ in respect of the acceleration which is prevailing at the tip portions at least during a dirt release period when the brush elements are free from contact to the surface during the rotation of the brush, is also supported by results of experiments which have been performed in the context of the present invention. These experiments have shown that the cleaning performance of the device according to the present invention improves with an increase of the angular velocity of the brush, which implies an increase of the acceleration at the tip portions of the brush elements during rotation.

When the drive means are adapted to realize centrifugal accelerations of the brush elements in the above-mentioned ranges, it is likely for the liquid droplets adhering to the brush elements to be expelled as a mist of droplets during a phase in which the brush elements are free from contact to the surface to be cleaned.

Combining the above-mentioned parameters for the linear mass density of the flexible brush elements with the parameters for the acceleration of the tips of the brush elements yields optimal cleaning performance of the rotatable brush, wherein practically all dirt particles and spilled liquid encountered by the brush are picked up by the brush elements and expelled at a position inside the nozzle housing.

A good combination of the linear mass density and the centrifugal acceleration at the tip portions of the brush elements is providing an upper limit for the Dtex value of 150 g/10 km and a lower limit for the centrifugal acceleration of 3,000 $m/s^2$. This parameter combination has shown to enable for excellent cleaning results, wherein the surface is practically freed of particles and dried in one go. Using this parameter combination has also shown to result in very good stain removing properties. The ability to also pick-up liquid with a brush is mainly caused by capillary and/or other adhesive forces that occur due to the chosen linear mass density of the brush elements and the occurring high speeds with which the brush is driven.

In order to realize the above-mentioned centrifugal accelerations at the tip portions of the brush elements, the drive means are, according to an embodiment of the present invention, adapted to realize an angular velocity of the brush which is in a range of 3,000 to 15,000 revolutions per minute, more preferably in a range of 5,000 to 8,000 revolutions per minute, during operation of the device. Experiments of the applicant have shown that optimal cleaning results can be obtained, when the brush is driven at an angular velocity which is at least 6,000 revolutions per minute.

However, the desired accelerations at the tip portions of the brush elements do not only depend on the angular velocity, but also on the radius, respectively on the diameter of the brush.

It is therefore, according to a further embodiment of the invention, preferred that the brush has a diameter which is in a range of 10 to 100 mm, more preferably in a range of 20 to 80 mm, and most preferably in a range of 35 to 50 mm, when the brush elements are in a fully outstretched condition. The length of the brush elements is preferably in a range of 1 to 20 mm, more preferably in a range of 8 to 12 mm, when the brush elements are in a fully outstretched condition.

According to an embodiment of the claimed cleaning device the cleaning device further comprises a vacuum aggregate that is configured to generate an under-pressure within a suction-area between the nozzle housing, the brush and the squeegee in a range of 3 to 70 mbar, preferably in a range of 4 to 50 mbar, most preferably in a range of 5 to 30 mbar. In a preferred embodiment the generated under-pressure in the suction-area is, especially when the squeegee is in the closed position, in a range of 17 to 27 mbar.

In contrast to the above-mentioned pressure ranges that are generated by the vacuum aggregate, state of the art vacuum cleaners need to apply higher under-pressures in order to receive acceptable cleaning results. However, due to the above-mentioned combination of the special brush with flexible brush elements and the squeegee element very good cleaning results may already be realized in the above-mentioned pressure ranges. Thus, also smaller vacuum aggregates may be used. This increases the freedom in the selection of the vacuum pump.

The presented cleaning device may further comprise positioning means for positioning the brush axis at a distance to the surface to be cleaned that is smaller than the radius of the brush with fully outstretched brush elements, to realize an indentation of the brush part contacting the surface to be cleaned during operation, which indentation is in a range from 2% to 12% of the brush diameter.

As a result, the brush elements are bent when the brush is in contact with the floor. Hence, as soon as the brush elements come into contact with the floor during rotation of the brush, the appearance of the brush elements changes from an outstretched appearance to a bent appearance, and as soon as the brush elements lose contact with the floor during rotation of the brush, the appearance of the brush elements changes from a bent appearance to an outstretched appearance. The same brush characteristics occur when the tip portions of the brush contact the first deflection surface of the first deflection element.

A practical range for an indentation of the brush is arranged from 2% to 12% of a diameter of the brush relating to a fully outstretched condition of the brush elements. In practical situations, the diameter of the brush as mentioned can be determined by performing an appropriate measurement, for example, by using a high-speed camera or a stroboscope which is operated at the frequency of a rotation of the brush.

A deformation of the brush elements or, to say it more accurately, a speed at which deformation can take place, is also influenced by the linear mass density of the brush elements. Furthermore, the linear mass density of the brush elements influences the power which is needed for rotating the brush. When the linear mass density of the brush elements is relatively low, the flexibility is relatively high, and the power needed for causing the brush elements to bend when they come into contact with the surface to be cleaned or with the first deflection surface is relatively low. This also means that a friction power which is generated between the brush elements and the floor or the first deflection surface is low, whereby any damages are prevented. Other advantageous effects of a relatively low linear mass density of the brush elements are a relatively high resistance to wear, a relatively small chance of damage by sharp objects or the like, and the capability to follow the surface to be cleaned in such a way that contact is maintained even when a substantial unevenness in the floor is encountered.

A factor which may play an additional role in the cleaning function of the rotatable brush is a packing density of the brush elements. When the packing density is large enough, capillary effects may occur between the brush elements, which enhance fast removal of liquid from the surface to be cleaned. According to an embodiment of the present invention the packing density of the brush elements is at least 30 tufts of brush elements per $cm^2$, wherein a number of brush elements per tuft is at least 500.

Arranging the brush elements in tufts forms additional capillary channels, thereby increasing the capillary forces of the brush for picking-up dirt particles and liquid droplets from the surface to be cleaned.

As it has been mentioned above, the presented cleaning device has the ability to realize extremely good cleaning results. These cleaning results can be even improved by actively wetting the surface to be cleaned. This is especially advantageous in case of stain removal. The liquid used in the process of enhancing adherence of dirt particles to the brush elements may be provided in various ways. In a first place, the rotatable brush and the flexible brush elements may be wetted by a liquid which is present on the surface to be cleaned. An example of such a liquid is water, or a mixture of water and soap. Alternatively, a liquid may be provided to the flexible brush elements by actively supplying the cleansing liquid to the brush, for example, by oozing the liquid onto the brush, or by injecting the liquid into a hollow core element of the brush.

According to an embodiment, it is therefore preferred that the cleaning device comprises means for supplying a liquid to the brush at a rate which is lower than 6 ml per minute per cm of a width of the brush in which the brush axis is extending. It appears that it is not necessary for the supply of liquid to take place at a higher rate, and that the above-mentioned rate suffices for the liquid to fulfill a function as a carrying/transporting means for dirt particles. Thus, the ability of removing stains from the surface to be cleaned can be significantly improved. An advantage of only using a little liquid is that it is possible to treat delicate surfaces, even surfaces which are indicated as being sensitive to a liquid such as water. Furthermore, at a given size of a reservoir containing the liquid to be supplied to the brush, an autonomy time is longer, i.e. it takes more time before the reservoir is empty and needs to be filled again.

It has to be noted that, instead of using an intentionally chosen and actively supplied liquid, it is also possible to use a spilled liquid, i.e. a liquid which is to be removed from the surface to be cleaned. Examples are spilled coffee, milk, tea, or the like. This is possible in view of the fact that the brush elements, as mentioned before, are capable of removing the liquid from the surface to be cleaned, and that the liquid can be removed from the brush elements under the influence of centrifugal forces as described in the foregoing.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1:
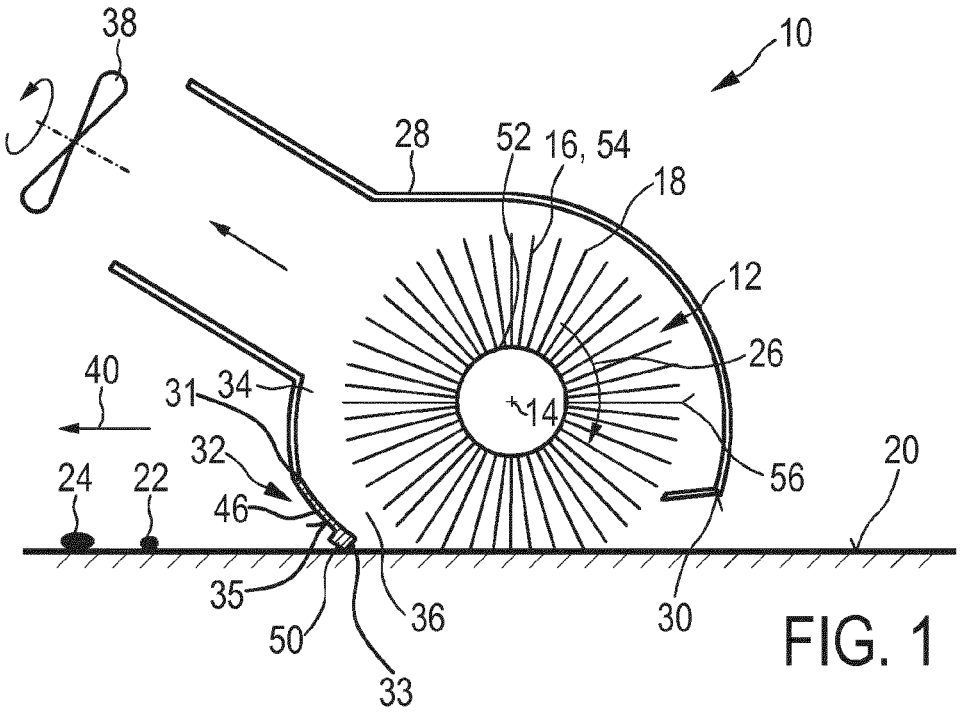
FIG. 1 shows a schematic cross-section of a first embodiment of a nozzle arrangement of a cleaning device according to the present invention, in a first working position.

FIG. 1 shows a schematic cross-section of a first embodiment of a nozzle arrangement 10 of a cleaning device 100 according to the present invention. The nozzle arrangement 10 comprises a brush 12 that is rotatable about a brush axis 14. Said brush 12 is provided with flexible brush elements 16 which are preferably realized by thin microfiber hairs. The flexible brush elements 16 comprise tip portions 18 which are adapted to contact a surface to be cleaned 20 during the rotation of the brush 12 and to pick-up dirt particles 22 and/or liquid particles 24 from said surface 20 (floor 20) during a pick-up period when the brush elements 16 contact the surface 20.

Further, the nozzle arrangement 10 comprises a drive means, e.g. a motor (not shown), for driving the brush 12 in a predetermined direction of rotation 26. Said drive means are preferably adapted to realize a centrifugal acceleration at the tip portions 18 of the brush elements 16 which is, in particular during a dirt release period when the brush elements 16 are free from contact to the surface 20 during the rotation of the brush 12, at least 3,000 $m/s^2$.

The brush 12 is at least partly surrounded by a nozzle housing 28. The arrangement of the brush 12 within the nozzle housing 28 is preferably chosen such that the brush 12 at least partially protrudes from a bottom side 30 of the nozzle housing 28. During use of the device 100, the bottom side 30 of the nozzle housing 28 faces towards the surface to be cleaned 20.

Also attached to said bottom side 30 of the nozzle housing 28 is a squeegee element 32. This squeegee element 32 is arranged such that it contacts the surface to be cleaned 20 during the use of the device 100. The squeegee is used as a kind of wiper for wiping dirt and/or liquid particles 22, 24 across or off the surface 20 when the nozzle 10 is moved. The squeegee 32 extends substantially parallel to the brush axis 14. The nozzle housing 28, the squeegee 32 and the brush 12 together define a suction area 34, which is located within the nozzle housing 28. It is to be noted that the suction area 34, in the meaning of the present invention, not only denotes the area between the brush 12, the squeegee 32 and the nozzle housing 28, but also denotes the space between the brush elements 16 for the time during the rotation of the brush 12, in which the brush elements 16 are inside the nozzle housing 28. The suction area 34 denotes as well an area that is defined between the squeegee 32 and the brush 12. The latter area will be in the following also denoted as suction inlet 36, which opens into the suction area 34.

By means of a vacuum aggregate 38, which is in these figures only shown in a schematic way, an under-pressure is generated in the suction area 34 for ingesting dirt and liquid particles 22, 24 that have been encountered and collected by the brush 12 and the squeegee 32. Said under-pressure preferably ranges between 3 and 70 mbar, more preferably between 4 and 50 mbar, most preferably between 5 and 30 mbar. This under-pressure is, compared to regular vacuum cleaners which apply an under-pressure of around 70 mbar, quite low. However, due to the properties of the brush 12, which will be explained further below, very good cleaning results may already be realized in the above-mentioned pressure ranges. Thus, also smaller vacuum aggregates 38 may be used. This increases the freedom in the selection of the vacuum pump.

During the rotation of the brush 12 dirt and/or liquid particles 22, 24 will be encountered on the surface 20 and either launched towards the inside of the nozzle housing 28 or against the squeegee 32. If the particles 22, 24 are launched against the squeegee 32 they will get reflected therefrom. These reflected particles 22, 24 will again reach the brush 12 and get launched again. In this way the particles 22, 24 bounce forth and back between the brush 12 and the squeegee 32 in an more or less zigzag-wise manner before they are finally ingested by the vacuum aggregate 38. Some of the dirt and/or liquid particles 22, 24 will however get launched from the surface 20 in such a flat manner that they will be resprayed back onto the surface 20 in the area between the brush 12 and the squeegee 32. Since the squeegee 32 acts as a kind of wiper, these particles 22, 24 will not get launched out of the nozzle housing 28 again. Due to the under-pressure that is applied by the vacuum aggregate 38 these re-sprayed particles 22, 24 will then also be ingested by the vacuum aggregate 38.

One of the central points of the present invention relates to the properties of the squeegee element 32 and its interaction with the brush 12. The squeegee element 32 is adapted to flex/flip around its longitudinal direction 48 between an open and a closed position depending on the movement direction 40 of the nozzle 10. It thereto comprises a flexible rubber lip 46 that is preferably made of polyurethane. The rubber lip 46 is at its fixed end 31 fixed to the bottom side 30 of the housing 28 (see e.g. FIGS. 5 to 7).

In order to guarantee good cleaning results in a backward stroke of the nozzle 10 (shown in FIG. 1) as well as in a forward stroke of the nozzle 10 (shown in FIG. 2), the squeegee 32 furthermore comprises a plurality of protrusions 50 for switching the squeegee 32 from the open to the closed position and vice versa, depending on the direction of movement 40 of the nozzle 10. These protrusions 50 are arranged at or near a free end 33 of the rubber lip 46 that during use is intended to touch the floor 20. More specifically, the protrusions 50 are arranged at or near the free end 33 of the rubber lip 46 on a backside 35 of the rubber lip 46 that faces away from the brush 12. The protrusions 50 protrude from said backside 35 of the rubber lip 46. The protrusions 50 are herein also referred to as studs 50.

If the nozzle 10 is moved in a forward stroke (shown in FIG. 2), where the squeegee is, seen in the direction of movement 40, located behind the brush 12, the squeegee 32 is arranged in a closed position. In this closed position the squeegee 32 is adapted to push or wipe dirt and/or liquid particles 22, 24 across or off the surface 20 by more or less gliding over the surface 20. In such a forward stroke the squeegee 32 acts as a kind of wiper that collects the remaining water from the surface 20, which has not been lifted or has been sprayed back from the brush 12 to the surface 20. The remaining water 24 which is collected by the squeegee can then be ingested by means of the applied under-pressure.

On the other hand, the squeegee 32 is arranged in its open position when the nozzle 10 is moved in a backward stroke (shown in FIG. 1), in which the squeegee 32 is, seen in the direction of movement 40 located in front of the brush 12, so that it would encounter the dirt and/or liquid particles 22, 24 on the surface 20 before they would be encountered by the brush 12. In this backward stroke the studs 50 flip the squeegee 32 to its open position. In this open position dirt and/or liquid particles 22, 24 can then enter into the suction inlet 36 through openings 44 that are created between the studs 50, the rubber lip 46 and the surface to be cleaned 20.

If the squeegee 32 was not able to switch to that open position in the backward stroke, only very small dirt particles 22 would be able to reach the suction inlet 36, while most of the dirt and/or liquid particles 22, 24 would be entangled by the squeegee 32 and pushed across the surface 20 without being able to enter the suction inlet 36. This would of course result in a poor cleaning and drying effect.

Figure 2:
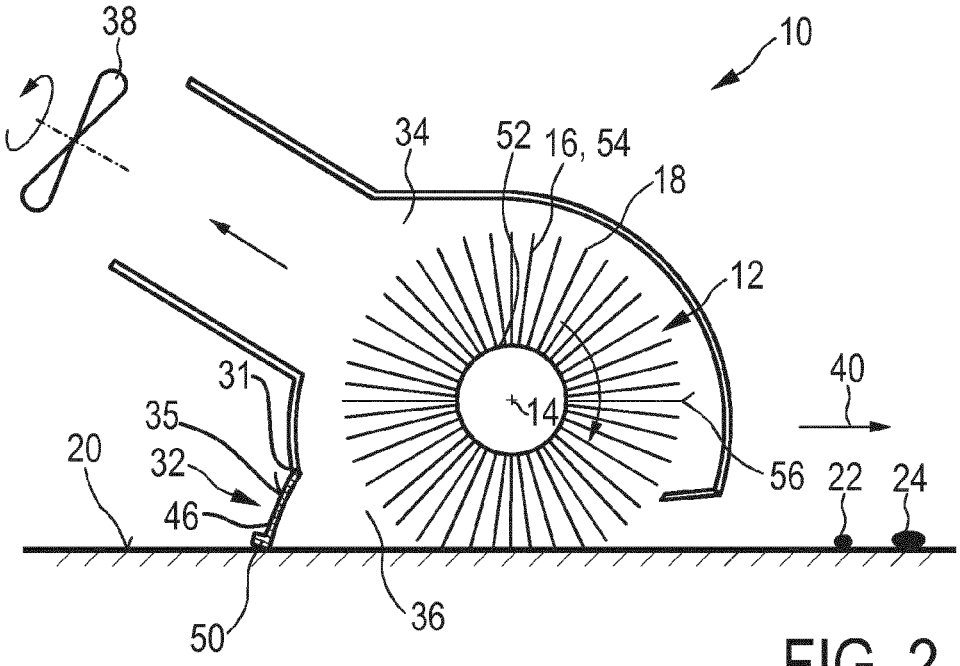
FIG. 2 shows a schematic cross-section of the first embodiment of the nozzle arrangement shown in FIG. 1 in a second working position.
Figure 3:
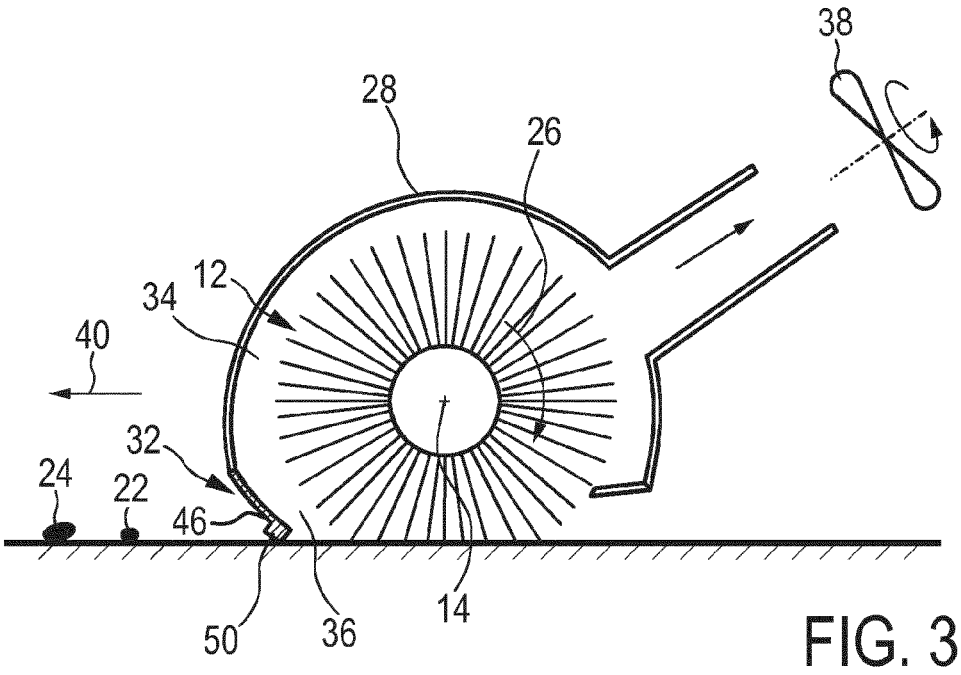
FIG. 3 shows a schematic cross-section of a second embodiment of the nozzle arrangement of the cleaning device according to the present invention, in a first working position.
Figure 4:
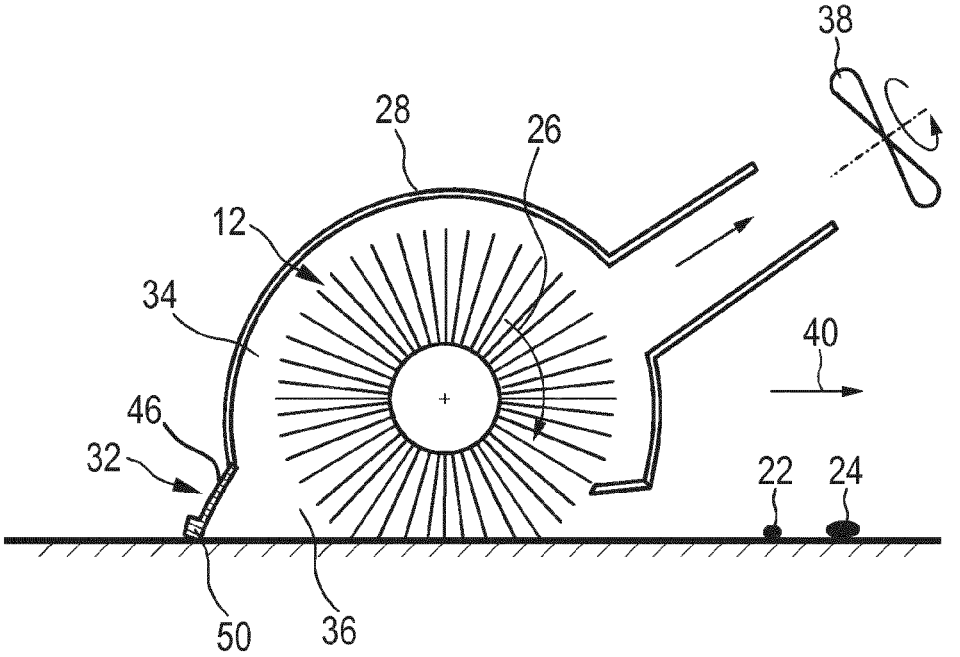
FIG. 4 shows a schematic cross-section of the second embodiment of the nozzle arrangement shown in FIG. 3 in a second working position.

FIGS. 3 and 4 show a second embodiment of the nozzle arrangement 10. These figures illustrate that the nozzle housing 28 may also have another form. The squeegee 32 can also be arranged at the front end of the nozzle housing 28, instead of being arranged at its back end as shown in FIGS. 1 and 2. However, by comparing FIGS. 3 and 4 with FIGS. 1 and 2 it can be seen that the squeegee 32 is still arranged on the side of the brush 12, where the brush elements 16 enter the nozzle housing 28 during the brush's rotation (see rotation direction 26).

As it can be seen from FIG. 3, the squeegee 32 has to be in this case again in the open position when the nozzle 10 is moved in the forward direction, in which the squeegee 32 is, seen in the direction of movement 40, located in front of the brush 12.

On the other hand, the squeegee 32 needs to be in its closed position when the nozzle is according to this embodiment moved in the backward direction as shown in FIG. 4, where the brush 12 is, seen in the movement direction 40, located in front of the squeegee 32 and encounters the dirt and/or liquid particles 22, 24 first.

Figure 5A:
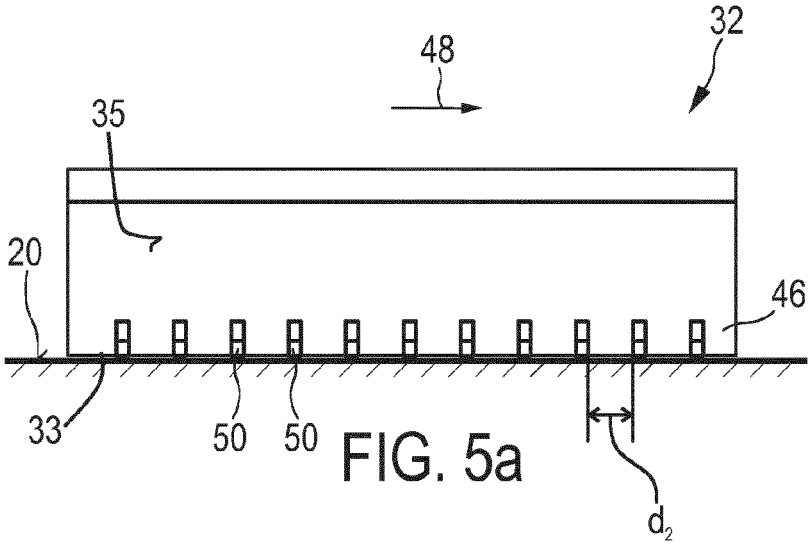
FIG. 5 shows a schematic side view (FIG. 5*a*) and a schematic cross-section (FIG. 5*b*) of a squeegee element of the nozzle arrangement according to the present invention in a first working position.
Figure 5B:
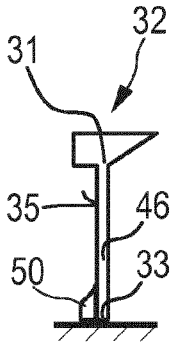
Figure 6A:
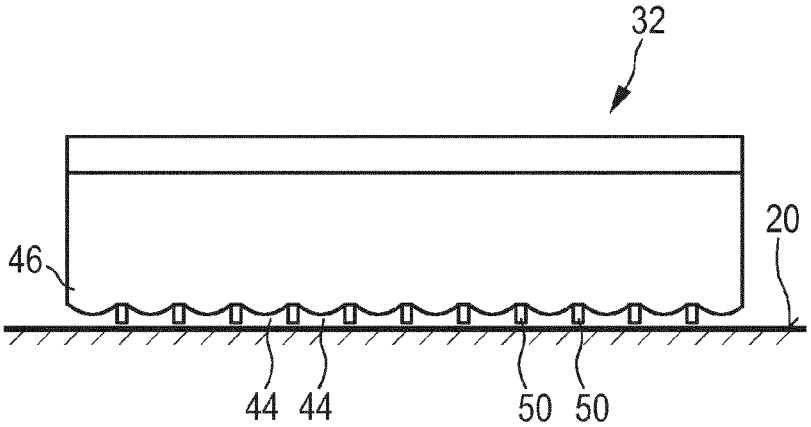
FIG. 6 shows a schematic side view (FIG. 6*a*) and a schematic cross-section (FIG. 6*b*) of the squeegee element shown in FIG. 5 in a second working position.
Figure 6B:
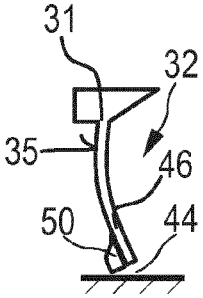
Figure 7A:
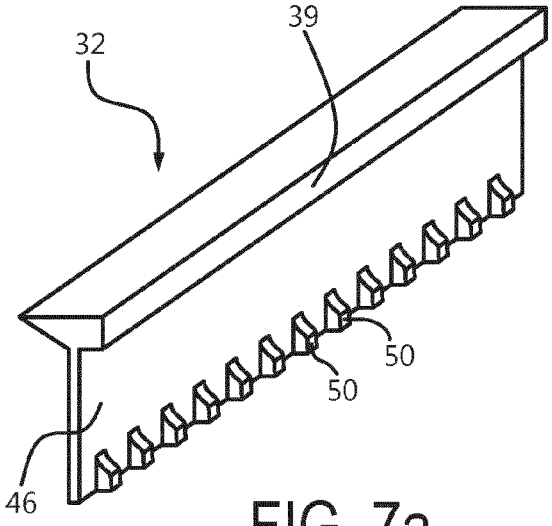
FIG. 7 shows a further preferred embodiment of the squeegee element in a perspective view (FIG. 7*a*) and a cross-sectional view (FIG. 7*b*)

Enlarged schematic views of the squeegee 32 are shown in FIGS. 5 to 7. FIGS. 5*a, b* show the squeegee 32 in its closed position, whereas FIGS. 6*a, b* show the squeegee 32 in its open position.

The studs 50 that are arranged near the free end 33 of the rubber lip 46, where the squeegee 32 is intended to touch the surface 20, are adapted to at least partly lift the rubber lip 46 from the surface 20, when the nozzle 10 is moved on the surface 20 in the backward direction 40 (as shown e.g. in FIG. 1). In this case the rubber lip 46 is bent and at least partly lifted, which is mainly due to the natural friction which occurs between the surface 20 and the studs 50. The studs 50 then act as a kind of stopper that decelerate the rubber lip 46 and forces it to flip over the studs 50. The squeegee 32 is thereby forced to glide on the studs 50, wherein the rubber lip 46 is lifted by the studs 50 and openings 44 occur in the space between the rubber lip 46 and the surface 20 (see FIGS. 6*a, b*).

It is evident that these openings 44 do not only enable dirt and/or liquid particles 22, 24 to enter the suction inlet 36. Also a lot more air will be sucked through the openings 44 into the suction area 34 compared to a forward stroke of the nozzle 10, where the squeegee 32 is in its closed position. This means that there is a difference in the flow behavior if the nozzle 10 is moved in a forward stroke (as shown in FIG. 2) or in a backward stroke (as shown in FIG. 1). The under-pressure within the suction area 34 will thus always be higher in the forward stroke (shown in FIG. 2) as in the backward stroke (shown in FIG. 1) (higher under-pressure means decreased absolute pressure).

These and other aspects show that the squeegee behavior has a very strong influence on the overall performance of the device. A central point of the present invention is the object to enable the usage of the device in both directions (forward and backward direction). These different movement directions 40 should not lead to a different cleaning performance, since the users would otherwise use the device 100 only in one direction. As a consequence this means that the squeegee 32 should have a similar behavior (dirt and liquid pick-up performance) as the brush 12. In the forward stroke, when the squeegee 32 is in its closed position, the squeegee 32 mainly determines the amount of dirt and liquid 22, 24 that is left behind on the floor 20. In the opposite backward direction it is, however, the brush 12, which mainly determines the amount of dirt and liquid 22, 24 that is left behind on the floor 20.

The behavior of the squeegee 32 is significantly influenced by the type of material that is used for the rubber lip 46 and the studs 50 as well as from the specific geometry of the rubber lip 46 and the studs 50.

Extensive experiments of the applicant have shown that a polyurethane material with a hardness between 25 and 60 Shore-A has met the above-mentioned requirement (similar behavior as brush 12) best. Regarding the geometry of the squeegee 32 different optimal geometry combinations have been found in the experiments that enable a dirt and liquid pick-up performance of the squeegee 32 that is comparable to the brush 12. The relation between the different dimensions of the squeegee 32 has been found to be best described in a force-displacement-diagram.

Figure 7B:
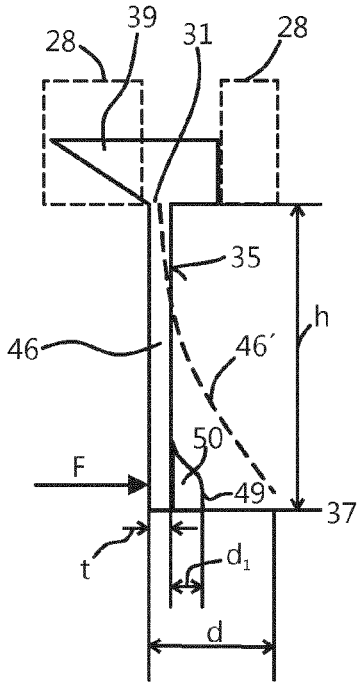
Figure 8:
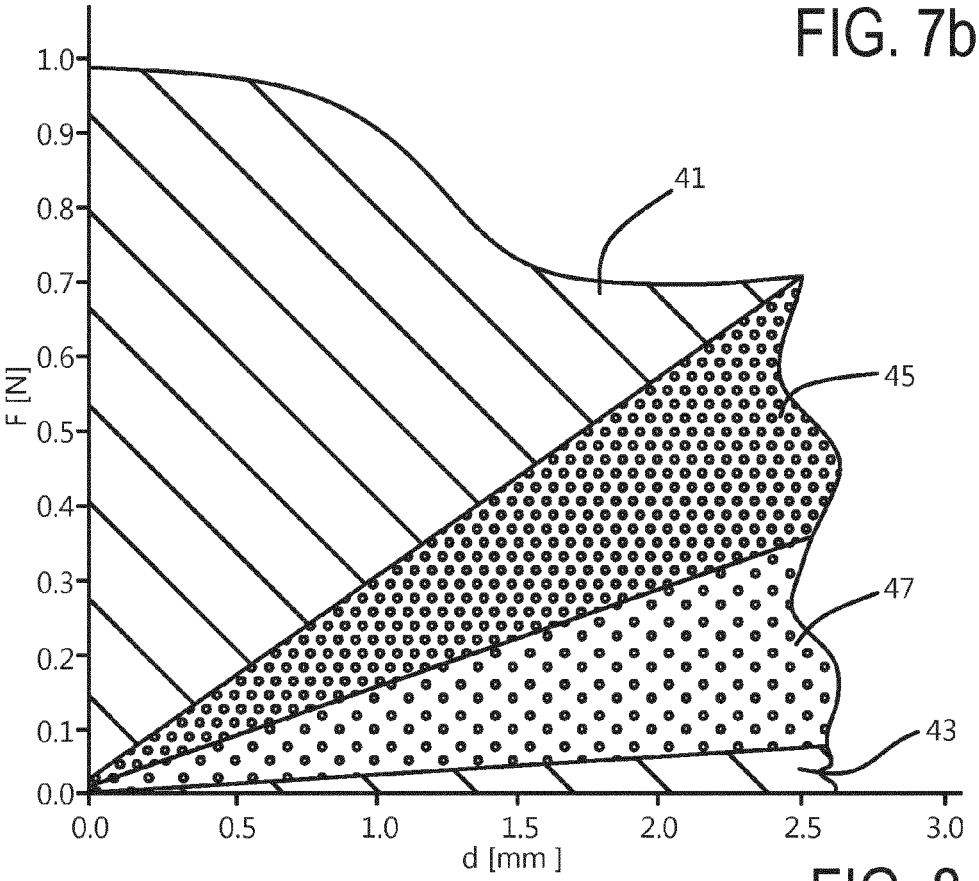
FIG. 8 shows a diagram illustrating a force-displacement-behavior of the squeegee element.

FIG. 8 shows the result of the applicant's experiments. This diagram shows the dependency of a force F acting on the free end 33 of the squeegee 32 perpendicular to the outer surface of the rubber lip 46 and the resulting displacement d of the free end 33 of the rubber lip 46 in the same direction. The force F is in FIG. 7*b* schematically illustrated by an arrow and the displacement d is shown therein as the distance between the free end 33 of the free-hanging rubber lip 46 and the free end 33 of a displaced/bent rubber lip 46' (illustrated as a dotted line). Force F is shown on the y-axis with a scale of 0.1 N and the displacement d is shown on the x-axis with a scale of 0.5 mm.

Different areas were identified during the experiments. Reference numeral 41 indicates the area where F/d is greater than 0.27 N/mm. Reference numeral 43 indicates the area where F/d is smaller than 0.02 N/mm. These areas 41, 43 have been found to be unfavorable. Squeegees with a force-displacement-behavior in the area 43 are too weak and instable. Squeegees with a force-displacement-behavior in the area 41 are too stiff to be applied in the nozzle arrangement 10 according to the present invention. Most of the prior art squeegees, however, have a force-displacement-behavior in this range. Especially double-squeegee solutions of the prior art have the target to increase the performance of the squeegee as much as possible, i.e. to wipe-off the largest possible amount of water with the squeegee. As this has been mentioned before, this is however not intended by the single-squeegee-single-brush solution according to the present invention, since it is one of the central ideas to have a squeegee 32 that behaves similar as the brush 12.

For the present invention a squeegee 32 with a force-displacement-behavior that is in a range shown in areas 45, 47 in FIG. 8 has shown to be optimal. Area 45 indicates the range of 0.13 N/mm<F/d<0.27 N/mm and area 47 indicates the range between 0.02 N/mm<F/d<0.13 N/mm. The most preferred working window is within area 47. Squeegees 32 with a force-displacement-behavior within range 45 have also shown good drying performance, but at the switching point (switching from the open to the closed position) a small mark of water was sometimes left on the floor 20. This mainly resulted from the fact that the flexibility of the squeegee 32 is in this range not high enough to switch very fast from the open to the closed position.

In summary this means that a squeegee 32 with a force-displacement-behavior of 0.02 N/mm<F/d<0.13 N/mm in combination with a hardness of the squeegee material between 25 and 60 Shore-A leads to a squeegee behavior that is with regard to the wetness level that is left behind on the surface 20 very similar to the brush's behavior. A user might therefore not even recognize a difference between a forward and a backward stroke of the nozzle 10.

Figure 10:
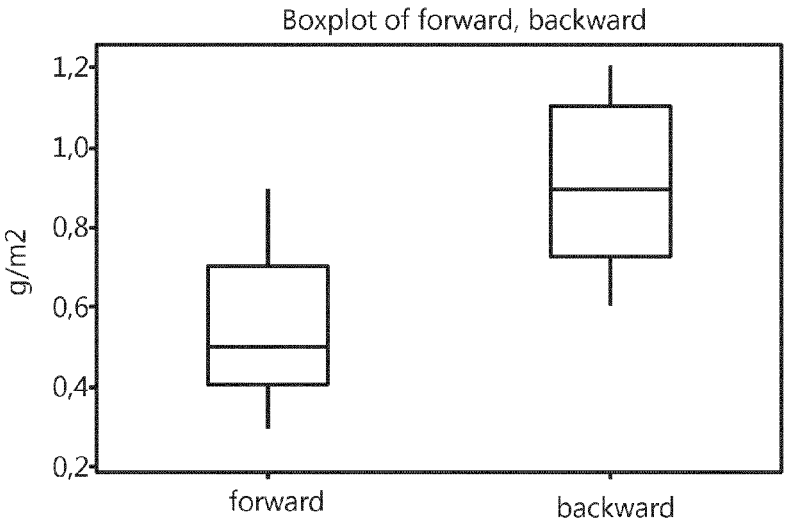
FIG. 10 shows a diagram comparing the performance of the nozzle arrangement in a forward and a backward stroke.

FIG. 10 shows a box plot comparing the wetness levels left behind on the floor in the forward and the backward stroke. The y-axis shows the wetness level on a floor 20 that has been cleaned with the device 100. From this box plot it may be seen that the wetness level in the forward stroke is almost the same as in the backward stroke. The small occurring difference may not even be noticed by consumers when using the appliance. This might be also explained by the way the liquid 24 is distributed on the floor 20. In the forward stroke the water is very equally distributed on the floor 20 by the squeegee 32. In the backward stroke the distribution of the liquid 24 on the floor 20 that is caused by the brush 12 is less equal. The film of water that is left behind on the floor 20 is therefore very similar and the difference may almost not be distinguished by a user. If a "regular" prior art squeegee was used, this would certainly not be the case. Squeegees of the prior art typically show wetness levels of about 0.1-0.2 g/m$^2$, since they are optimized to dry the floor 20 as good as possible.

In the following, concrete geometrical dimensions of the squeegee 32 shall be illustrated with which the above-mentioned force-displacement-behavior may be reached in a best possible manner. These dimensions are schematically illustrated in FIG. 7*b*.

According to a preferred embodiment of the present invention, the flexible rubber lip 46 has a height h that ranges from 5 mm to 20 mm. A most preferred height h is in around or equal to 8.5 mm. It shall be noted that the height h is measured between the free end 33 and the fixed end 31 of the flexible rubber lip 46. The fixed end 31 denotes the transition point between the upper part 39 of the squeegee 32 that is fixed in the nozzle housing 28 and the lower part of the squeegee 32 that hangs down from the nozzle housing 28. In FIG. 7*b* the dotted rectangles illustrate the fixation of the squeegee 32 within the nozzle housing 28.

The thickness t of the flexible rubber lip 46 preferably ranges from 0.5 mm to 3 mm. A most preferred thickness t is between 0.85 mm to 1 mm. In contrast to the example illustrated in FIG. 7*b*, the cross section of the flexible rubber lip 46 may also be slightly tapered, e.g. having a thickness t of 0.85 mm at the thinnest point and a thickness of 1 mm at the thickest point.

It shall be noted that the above-mentioned dimensions are to be considered as optimal dimensions of the squeegee 32. It should however be noted that these dimensions are related with each other. A flexible rubber lip 46 with a large height h can, for example, have a larger thickness compared to a very small rubber lip 46. A very hard rubber lip 46 can on the other hand also have a larger height h and/or a smaller thickness t, while still having the above-mentioned desired force-displacement-behavior.

The geometry and size of the protrusions 50 is also an important feature. The distance $d_1$ between the front end 49 of the protrusions 50, that faces away from the rubber lip 46, and the backside 35 of the rubber lip 46 e.g. determines the size of the openings 44 (see FIG. 6*a*) during the backward stroke. If this distance $d_1$ is too large, the openings 44 will get too large, so that dirt and liquid particles 22, 24 may shoot out under the squeegee 32 in the backward stroke. As already explained above, too large openings 44 could also significantly decrease the under-pressure within the suction area 34, leading to a significantly different flow rate in the backward stroke compared to the forward stroke of the nozzle 10. This shall be prevented as well. Too large protrusions 50 furthermore increase the risk that the rubber lip 46 is bent too much and the squeegee 32 may get in contact with the brush 12. The size $d_1$ of the protrusions 50 therefore also depends from the distance of the squeegee 32 to the brush 12 and the minimum angle with which dirt and liquid particles 22, 24 are launched from the brush 12 during its rotation.

Experiments have shown that the above-mentioned requirements may be reached best if the dimension $d_1$ of the protrusions 50 ranges from 0.5 mm to 4 mm. An optimal dimension $d_1$ has been found to be around or equal to 1.8 mm. It shall be noted again that also these dimensions are dependent on the above-mentioned dimensions of the rubber lip 46, i.e. on the height h and the thickness t.

It is furthermore important that the squeegee 32 is not arranged too far away from the brush 12, since this would otherwise lead to unwanted water marks that are left on the floor 20. A distance between the brush's tip portions 18 and the free end 33 of the rubber lip 46 is in the open position of the squeegee 32 preferably between 5 and 10 mm. In the closed position of the squeegee 32, this distance preferably ranges between 15 and 20 mm.

A further important feature is the distance $d_2$ between two of said protrusions 50 (see FIG. 5*a*). If said distance $d_2$ is too large, the flexible rubber lip 46 could deform and thereby close the intended openings 44 that are created during the backward stroke of the nozzle 10. If said distance $d_2$ is on the other hand too small, larger particles may not enter the nozzle 10 through the openings 44 during the backward stroke. A good trade-off solution has been found to be $5<d_2<15$ mm.

Figure 9:
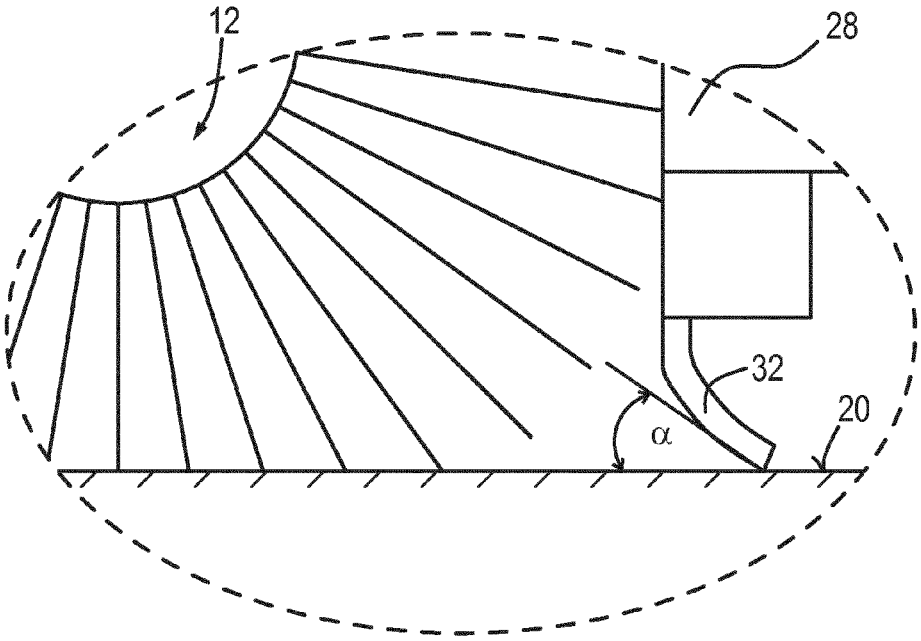
FIG. 9 shows an enlarged schematic view of the nozzle arrangement according to a further embodiment of the present invention.

FIG. 9 schematically illustrates a further preferred feature of the squeegee 32. To wipe the water 24 from the floor 20 and have a uniform wetness on the floor 20 and an evenly distributed drying time of the remaining water 20, the contact angle $\alpha$ between the rubber lip 46 and the surface 20 is in the closed position of the squeegee 32, preferably adapted to be between 35° and 50°.

In the following further properties of the brush 12 and the rotational speed with which the brush 12 is driven shall be presented. The brush 12 preferably has a diameter which is in a range of 20 to 80 mm, and the driving means may be capable of rotating the brush 12 at an angular velocity which is at least 3,000 revolutions per minute, preferably at an angular velocity around 6,000 revolutions per minute and above. A width of the brush 12, i.e. a dimension of the brush 12 in a direction in which the rotation axis 14 of the brush 12 is extending, may be in an order of 25 cm, for example.

On an exterior surface of a core element 52 of the brush 12, tufts 54 are provided. Each tuft 54 comprises hundreds of fiber elements, which are referred to as brush elements 16. For example, the brush elements 16 are made of polyester or nylon with a diameter in an order of about 10 micrometers, and with a Dtex value which is lower than 150 g per 10 km. A packing density of the brush elements 16 may be at least 30 tufts 54 per $cm^2$ on the exterior surface of the core element 52 of the brush 12.

The brush elements 16 may be arranged rather chaotically, i.e. not at fixed mutual distances. Furthermore, it shall be noted that an exterior surface 56 of the brush elements 16 may be uneven, which enhances the capability of the brush elements 16 to catch liquid droplets 24 and dirt particles 22. In particular, the brush elements 16 may be so-called microfibers, which do not have a smooth and more or less circular circumference, but which have a rugged and more or less star-shaped circumference with notches and grooves. The brush elements 16 do not need to be identical, but preferably the linear mass density of a majority of a total number of the brush elements 16 of the brush 12 meets the requirement of being lower than 150 g per 10 km, at least at tip portions 18.

By means of the rotating brush 12, in particular by means of the brush elements 16 of the rotating brush 12, dirt particles 22 and liquid 24 are picked up from the surface 20, and are transported to a collecting position inside the cleaning device 100.

Due to the rotation of the brush 12, a moment occurs at which a first contact with the surface 20 is realized at a first position. The extent of contact is increased until the brush elements 16 are bent in such a way that the tip portions 18 of the brush elements 16 are in contact with the surface 20. The tip portions 18 as mentioned slide across the surface 20 and encounter dirt particles 22 and liquid 24 in the process, wherein an encounter may lead to a situation in which a quantity of liquid 24 and/or a dirt particles 22 are moved away from the surface 20 to be cleaned and are taken along by the brush elements 16 on the basis of adhesion forces. In the process, the brush elements 16 may act more or less like a whip for catching and dragging particles 22, 24, which is force-closed and capable of holding on to a particle 22, 24 on the basis of a functioning which is comparable to the functioning of a band brake. Furthermore, the liquid 24 which is picked up may pull a bit of liquid with it, wherein a line of liquid is left in the air, which is moving away from the surface 20. The occurring accelerations at the tip portions 18 of the brush elements 16 cause the dirt particles 22 and liquid droplets 24 to be automatically released from the brush 12, when the brush elements loose contact from the floor 20 during their rotation. Since not all dirt particles 22 and liquid droplets 24 may be directly ingested by the vacuum aggregate 38, a small amount of dirt and liquid will be flung back onto the surface 20 in the area where the brush elements 16 loose the contact from the surface 20. However, this effect of re-spraying the surface 20 is overcome by the squeegee element 32 which collects this re-sprayed liquid and dirt by acting as kind of wiper (in the closed position, in the forward stroke), so that the remaining liquid 24 and dirt 22 may then be ingested due to the applied under-pressure. Therefore, only a small amount of liquid and dirt particles 22, 24 leaves the nozzle 10 behind the squeegee 32. As mentioned-above, said rest amount of water and dirt is similar to the amount of water and dirt that is left on the floor 20 by the brush 12 if the nozzle 10 performs a backward stroke.

Due to the chosen technical parameters the brush elements 16 have a gentle scrubbing effect on the surface 20, which contributes to counteracting adhesion of liquid 24 and dirt particles 22 to the surface 20.

As the brush 12 rotates, the movement of the brush elements 16 over the surface 20 continues until a moment occurs at which contact is eventually lost. When there is no longer a situation of contact, the brush elements 16 are urged to assume an original, outstretched condition under the influence of centrifugal forces which are acting on the brush elements 16 as a result of the rotation of the brush 12. As the brush elements 16 are bent at the time that there is an urge to assume the outstretched condition again, an additional, outstretching acceleration is present at the tip portions 18 of the brush elements 16, wherein the brush elements 16 swish from the bent condition to the outstretched condition, wherein the movement of the brush elements 16 is comparable to a whip which is swished. The acceleration at the tip portions 18 at the time the brush elements 16 have almost assumed the outstretched condition again meets a requirement of being at least 3,000 $m/sec^2$.

Under the influence of the forces acting at the tip portions 18 of the brush elements 16, the quantities of dirt particles 22 and liquid 24 are expelled from the brush elements 16, as these forces are considerably higher than the adhesion forces. Hence, the liquid 24 and the dirt particles 22 are forced to fly away in a direction which faces away from the surface 20. The most part of the liquid 24 and the dirt particles 22 is then ingested by the vacuum aggregate. By means of the squeegee element 32 and the under-pressure generated in the suction area 34, as explained above, it is ensured that also most parts of the remaining liquid 24 and the dirt 22, that is sprayed back from the brush 12 to the surface 20, is collected and then also ingested.

Under the influence of the acceleration, the liquid 24 may be expelled in small droplets. This is advantageous for further separation processes such as performed by the vacuum fan aggregate 38, in particular the centrifugal fan of the vacuum aggregate 38, which serves as a rotatable air-dirt separator. It is noted that suction forces such as the forces exerted by the centrifugal fan do not play a role in the above-described process of picking up liquid and dirt by means of brush elements 16. However, these suction forces are necessary for picking up the dirt and liquid that has been collected by the squeegee.

Besides the functioning of each of the brush elements 16, as described in the foregoing, another effect which contributes to the process of picking up dirt particles 22 and liquid 24 may occur, namely a capillary effect between the brush elements 16. In this respect, the brush 12 with the brush elements 16 is comparable to a brush 12 which is dipped in a quantity of paint, wherein paint is absorbed by the brush 12 on the basis of capillary forces.

It appears from the foregoing that the brush 12 according to the present invention has the following properties:

- the soft tufts 54 with the flexible brush elements 16 will be stretched out by centrifugal forces during the contact-free part of a revolution of the brush 12;
- it is possible to have a perfect fit between the brush 12 and the surface 20 to be cleaned, since the soft tufts 54 will bend whenever they touch the surface 20, and straighten out whenever possible under the influence of centrifugal forces;
- the brush 12 constantly cleans itself, due to sufficiently high acceleration forces, which ensures a constant cleaning result;
- heat generation between the surface 20 and the brush 12 is minimal, because of a very low bending stiffness of the tufts 54;
- a very even pick-up of liquid from the surface 20 and a very even overall cleaning result can be realized, even if creases or dents are present in the surface 20, on the basis of the fact that the liquid 24 is picked up by the tufts 54 and not by an airflow as in many conventional devices; and dirt 22 is removed from the surface 20 in a gentle yet effective way, by means of the tufts 54, wherein a most efficient use of energy can be realized on the basis of the low stiffness of the brush elements 16.

On the basis of the relatively low value of the linear mass density, it may be so that the brush elements 16 have very low bending stiffness, and, when packed in tufts 54, are not capable of remaining in their original shape. In conventional brushes, the brush elements spring back once released. However, the brush elements 16 having the very low bending stiffness as mentioned will not do that, since the elastic forces are so small that they cannot exceed internal friction forces which are present between the individual brush elements 16. Hence, the tufts 54 will remain crushed after deformation, and will only stretch out when the brush 12 is rotating.

In comparison with conventional devices comprising hard brushes (agitators) for contacting a surface to be cleaned, the brush 12 which is used according to the present invention is capable of realizing cleaning results which are significantly better, due to the working principle according to which brush elements 16 are used for picking up liquid 24 and dirt 22 and taking the liquid 24 and the dirt 22 away from the surface 20 to be cleaned, wherein the liquid 24 and the dirt 22 are flung away by the brush elements 16 before they contact the surface 20 again in a next round. The microfiber hairs that are used as brush elements 16 also have the advantage that the hairs serve as a flow restriction when passing the restriction element. The brush 12 therefore shows a very good sealing effect. Stiff hairs of an agitator or adjutator could instead not do so.

Figure 11:
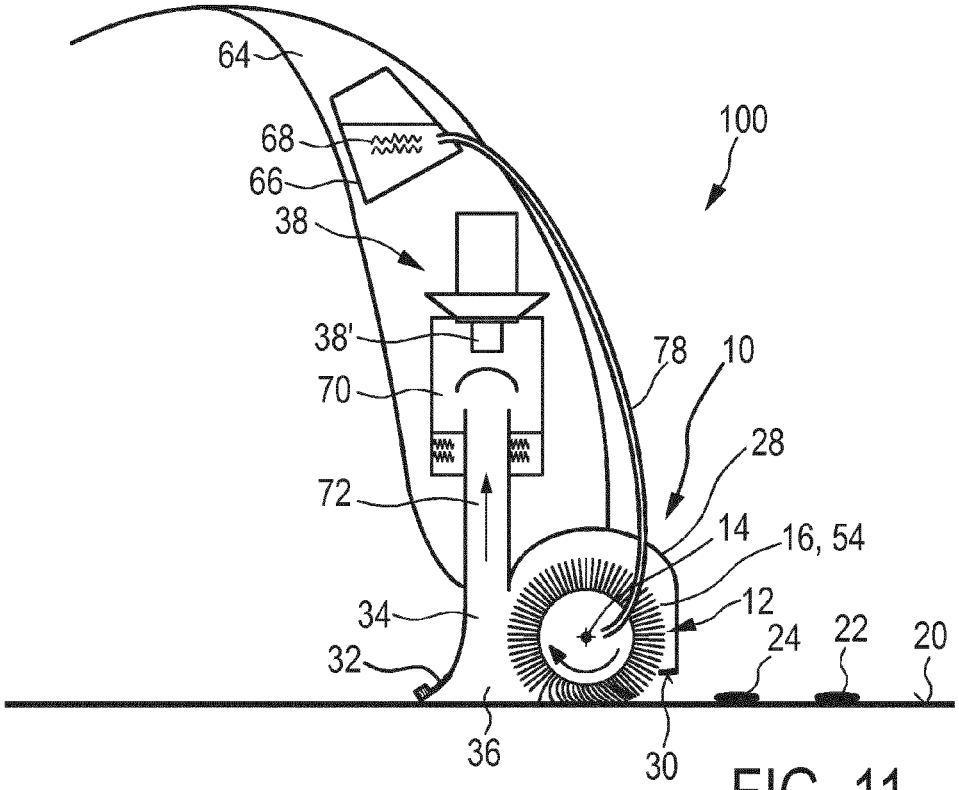
FIG. 11 shows a schematic cross-section of the cleaning device according to the present invention in its entirety.

FIG. 11 provides a view of the cleaning device 100 according to the present invention in its entirety. According to this schematic arrangement the cleaning device 100 comprises a nozzle 10 with a nozzle housing 28 in which the brush 12 is rotatably mounted on the brush axis 14. A drive means, which can be realized being a regular motor, such as e.g. an electro motor (not shown), is preferably connected to or even located on the brush axis 14 for the purpose of driving the brush 12 in rotation. It is noted that the motor may also be located at any other suitable position within the cleaning device 100.

In the nozzle housing 28, means such as wheels (not shown) are arranged for keeping the rotation axis 14 of the brush 12 at a predetermined distance from the surface 20 to be cleaned.

As already explained above, the squeegee element 32 is preferably spaced apart from the brush 12 and attached to the bottom side 30 of the nozzle housing 28. In some embodiments the squeegee 32 may also be at least partly in contact with the brush 12. It extends substantially parallel to the brush axis 14, thereby defining a suction area 34 within the nozzle housing 28 in between the squeegee element 32 and the brush 12, which suction area 34 has a suction inlet 36 which is located at the bottom side 30 of the nozzle housing 28 facing the surface 20 to be cleaned.

Besides the nozzle housing 28, the brush 12 and the squeegee element 32, the cleaning device 100 is preferably provided with the following components:

a handle 64 which allows for easy manipulation of the cleaning device 100 by a user;

a reservoir 66 for containing a cleansing liquid 68 such as water;

a debris collecting container 70 for receiving liquid 24 and dirt particles 22 picked up from the surface 20 to be cleaned;

a flow channel in the form of, for example, a hollow tube 72, connecting the debris collecting container 70 to the suction area 34, which suction area 34 constitutes the suction inlet 36 on the bottom side 30 of the nozzle 10. It has to be noted that, in the meaning of the present invention the flow channel including the hollow tube 72 may also be denoted as suction area 34 in which the above mentioned under-pressure is applied by the vacuum aggregate 38; and the vacuum fan aggregate 38 comprising a centrifugal fan 38', arranged at a side of the debris collecting chamber 70 which is opposite to the side where the tube 72 is arranged.

For sake of completeness, it is noted that within the scope of the present invention, other and/or additional constructional details are possible. For example, an element may be provided for deflecting the debris 22, 24 that is flung upwards, so that the debris 22, 24 first undergoes a deflection before it eventually reaches the debris collecting chamber 70.

Also, the vacuum fan aggregate 38 may be arranged at another side of the debris collecting chamber 70 than the side which is opposite to the side where the tube 72 is arranged.

Figure 12:
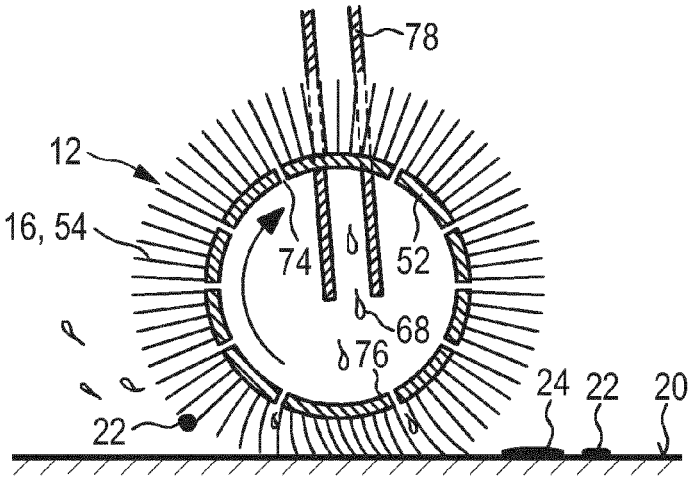
FIG. 12 shows a schematic cross-section of an embodiment of a brush of the cleaning device.

According to an embodiment, which is shown in FIG. 12, the brush 12 comprises a core element 52. This core element 52 is in the form of a hollow tube provided with a number of channels 74 extending through a wall 76 of the core element 52. For the purpose of transporting cleansing fluid 68 from the reservoir 66 to the inside of the hollow core element 52 of the brush 12, e.g. a flexible tube 78 may be provided that leads into the inside of the core element 52.

According to this embodiment cleansing fluid 68 may be supplied to the hollow core element 52, wherein, during the rotation of the brush 12, the liquid 68 leaves the hollow core element 52 via the channels 74, and wets the brush elements 16. In this way the liquid 68 also drizzles or falls on the surface 20 to be cleaned. Thus, the surface 20 to be cleaned becomes wet with the cleansing liquid 68. This especially enhances the adherence of the dirt particles 22 to the brush elements 16 and, therefore improves the ability to remove stains from the surface 20 to be cleaned.

According to the present invention, the rate at which the liquid 68 is supplied to the hollow core element 52 can be quite low, wherein a maximum rate can be 6 ml per minute per cm of the width of the brush 12, for example.

However, it is to be noted that the feature of actively supplying water 68 to the surface 20 to be cleaned using hollow channels 74 within the brush 12 is not a necessary feature. Alternatively, a cleansing liquid could be supplied by spraying the brush 12 from outside or by simply immersing the brush 12 in cleansing water before the use. Instead of using an intentionally chosen liquid, it is also possible to use a liquid that has been already spilled, i.e. a liquid that needs to be removed from the surface 20 to be cleaned. In summary, it is preferred that the device 100 comprises a liquid supplier for actively supplying a cleansing liquid 68 to the brush 12.

The pick-up of the cleansing water 68 from the floor is, as already mentioned above, either done by the squeegee element 32 which collects the water by acting as a kind of wiper transporting liquid to the suction area 34 where it is ingested due to the under-pressure generated by the vacuum aggregate 38, or the water is directly picked-up from the floor by the brush 12. In comparison with conventional devices comprising hard brushes that are not able to pick-up water, the brush 12 used according to the present invention is capable of picking-up water. The realized cleaning results are thus significantly better.

The technical parameters regarding the brush 12, the brush elements 16 and the drive means result from experiments which have been performed in the context of the present invention.

In the following, one of the experiments and the results of the experiment will be described. The tested brushes were equipped with different types of fiber materials used for the brush elements 16, including relatively thick fibers and relatively thin fibers. Furthermore, the packing density as well as the Dtex values have been varied. The particulars of the various brushes are given in the following table.

| | packing density (# tufts/cm$^2$) | fibers per tuft | Dtex value (g/10 km) | fiber material | fiber length (mm) | fiber appearance |
|---|---|---|---|---|---|---|
| brush 1 | 160 | 9 | 113.5 | nylon | 10 | springy, straight |
| brush 2 | 25 | 35 | 31.0 | nylon | 11 | fairly hard, curled |
| brush 3 | 40 | 90 | 16.1 | — | 11 | very soft, twined |
| brush 4 | 50 | 798 | 0.8 | polyester | 11 | very soft, twined |

The experiment includes rotating the brush under similar conditions and assessing cleaning results, wear, and power to the surface 20 subjected to treatment with the brush 12. This provides an indication of heat generation on the surface 20. The outcome of the experiment is reflected in the following table, wherein a mark 5 is used for indicating the best results, and lower marks are used for indicating poorer results.

| | stain removal | water pick-up | wear | power to the surface |
|---|---|---|---|---|
| Brush 1 | 5 | 3 | 3 | 3 |
| Brush 2 | 5 | 3 | 1 | 4 |
| Brush 3 | 5 | 4 | 4 | 5 |
| Brush 4 | 5 | 5 | 5 | 5 |

Among other things, the experiment proves that it is possible to have brush elements 16 with a linear mass density in a range of 100 to 150 g per 10 km, and to obtain useful cleaning results, although it appears that the water pick-up, the wear behavior and the power consumption are not so good. It is concluded that an appropriate limit value for the linear mass density is 150 g per 10 km. However, it is clear that with a much lower linear mass density, the cleaning results and all other results are very good. Therefore, it is preferred to apply lower limit values, such as 125 g per 10 km, 50 g per 10 km, 20 g per 10 km, or even 5 g per 10 km. With values in the latter order, it is ensured that cleaning results are excellent, water pick-up is optimal, wear is minimal, and power consumption and heat generation on the surface 20 are sufficiently low.

It is noted that the minimum value of 3,000 m/sec$^2$ in respect of the acceleration which is prevailing at tips 18 of the brush elements 16 during some time per revolution of the brush 12, in particular some time during a dirt release period, in which there is no contact between the brush elements 16 and the surface 20, is supported by results of experiments which have been performed in the context of the present invention.

In the following, one of the experiments and the results of the experiment will be described. The following conditions are applicable to the experiment:

1) A brush 12 having a diameter of 46 mm, a width of approximately 12 cm, and polyester brush elements 16 with a linear mass density of about 0.8 g per 10 km, arranged in tufts 54 of about 800 brush elements 16, with approximately 50 tufts 54 per cm$^2$, is mounted on a motor shaft.

2) The weight of the assembly of the brush 12 and the motor is determined.

3) The power supply of the motor is connected to a timer for stopping the motor after a period of operation of 1 second or a period of operation of 4 seconds.

4) The brush 12 is immersed in water, so that the brush 12 is completely saturated with the water. It is noted that the brush 12 which is used appears to be capable of absorbing a total weight of water of approximately 70 g.

5) The brush 12 is rotated at an angular velocity of 1,950 revolutions per minute, and is stopped after 1 second or 4 seconds.

6) The weight of the assembly of the brush 12 and the motor is determined, and the difference with respect to the dry weight, which is determined under step 2), is calculated.

7) Steps 4) to 6) are repeated for other values of the angular velocity, in particular the values as indicated in the following table, which further contains values of the weight of the water still present in the brush 12 at the stops after 1 second and 4 seconds, and values of the associated centrifugal acceleration, which can be calculated according to the following equation:

$$a=(2*\pi*f)^2*R$$

in which:

a=centrifugal acceleration (m/s$^2$)

f=brush frequency (Hz)

R=radius of the brush 12 (m)

| angular velocity (revolutions per minute) | weight of water present after 1 s (g) | weight of water present after 4 s (g) | centrifugal acceleration (m/s$^2$) |
|---|---|---|---|
| 1,950 | 8.27 | 7.50 | 959 |
| 2,480 | 5.70 | 4.57 | 1,551 |
| 3,080 | 3.70 | 3.11 | 2,393 |
| 4,280 | 2.52 | 1.97 | 4,620 |
| 5,540 | 1.95 | 1.35 | 7,741 |
| 6,830 | 1.72 | 1.14 | 11,765 |
| 7,910 | 1.48 | 1.00 | 15,780 |
| 9,140 | 1.34 | 0.94 | 21,069 |

Figure 13:
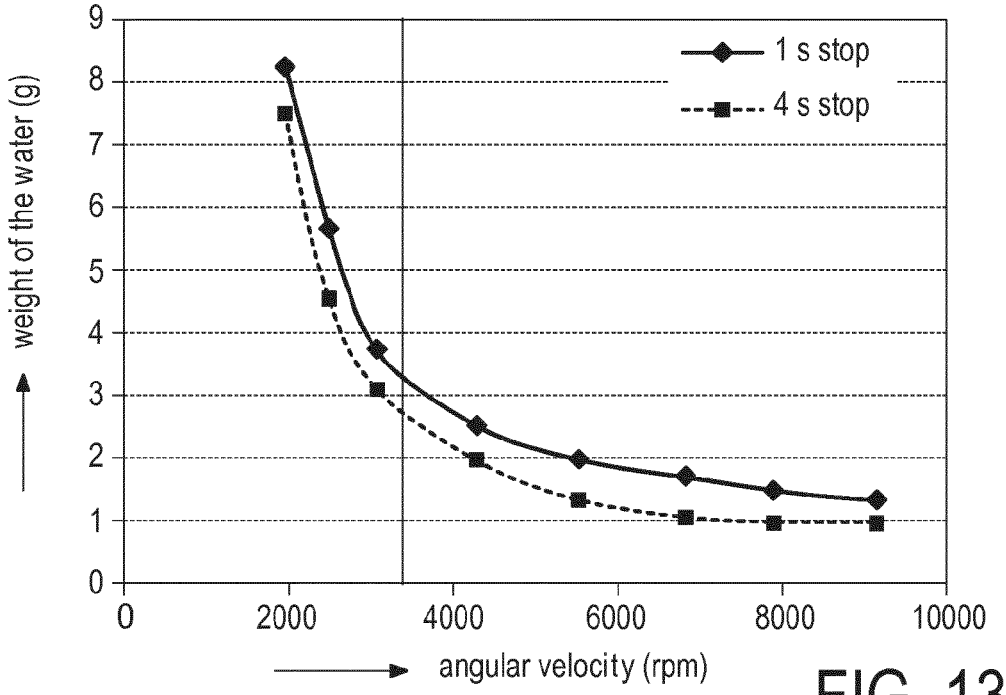
FIG. 13 shows a graph which serves for illustrating a relation between an angular velocity of a brush and a self-cleaning capacity of said brush.
Figure 14:
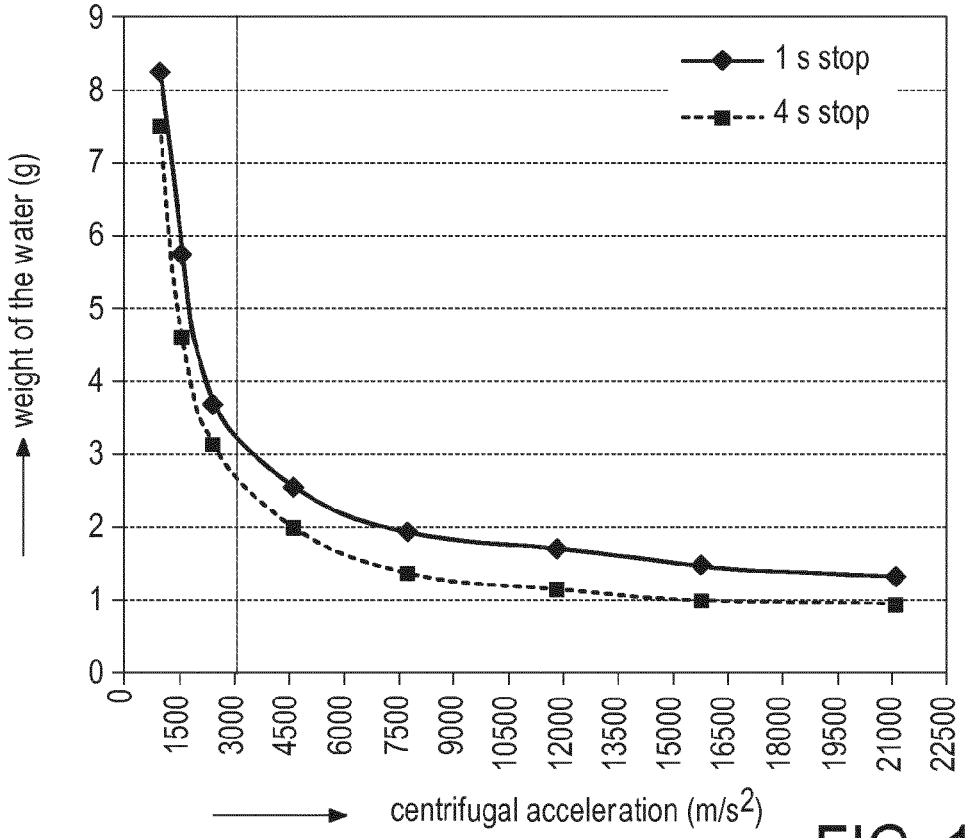
FIG. 14 shows a graph which serves for illustrating a relation between a centrifugal acceleration of a brush and a self-cleaning capacity of said brush.
Figure 15:
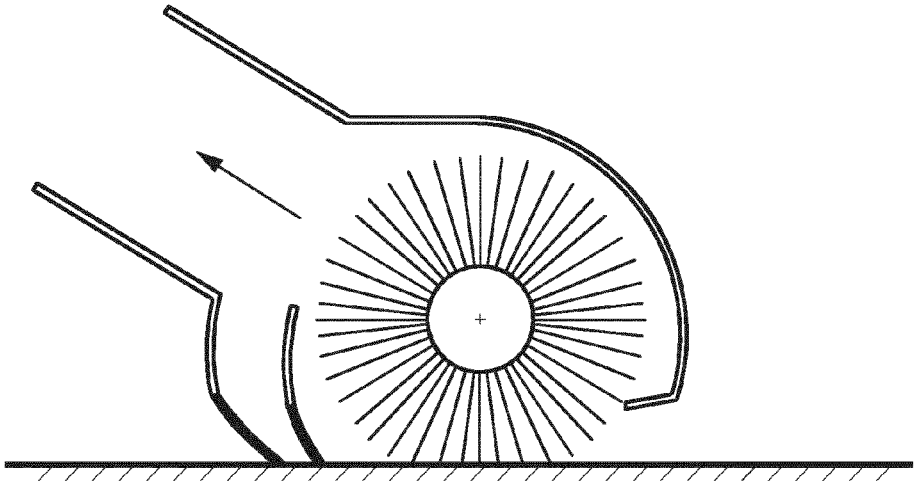
FIG. 15 shows a schematic cross-section of an exemplary nozzle arrangement according to the state of the art.

The relation which is found between the angular velocity and the weight of the water for the two different stops is depicted in the graph of FIG. 13, and the relation which is found between the centrifugal acceleration and the weight of the water for the two different stops is depicted in the graph of FIG. 14, wherein the weight of the water is indicated at the vertical axis of each of the graphs. It appears from the graph of FIG. 13 that the release of water by the brush 12 strongly decreases, when the angular velocity is lower than about 4,000 revolutions per minute. Also, it seems to be rather stable at angular velocities which are higher than 6,000 revolutions per minute to 7,000 revolutions per minute.

A transition in the release of water by the brush 12 can be found at an angular velocity of 3,500 revolutions per minute, which corresponds to a centrifugal acceleration of 3,090 $m/s^2$. For sake of illustration of this fact, the graphs of FIGS. 13 and 14 contain a vertical line indicating the values of 3,500 revolutions per minute and 3,090 $m/s^2$, respectively.

On the basis of the results of the experiment as explained in the foregoing, it may be concluded that a value of 3,000 $m/s^2$ in respect of an acceleration at tips 18 of the brush elements 16 during a contact-free period is a realistic minimum value as far as the self-cleaning capacity of brush elements 16 which meet the requirement of having a linear mass density which is lower than 150 g per 10 km, at least at tip portions 18, is concerned. A proper performance of the self-cleaning function is important for obtaining good cleaning results, as has already been explained in the foregoing.

For sake of completeness, it is noted that in the cleaning device 100 according to the present invention, the centrifugal acceleration may be lower than 3,000 $m/s^2$. The reason is that the acceleration which occurs at tips 18 of the brush elements 16 when the brush elements 16 are straightened out can be expected to be higher than the normal centrifugal acceleration. The experiment shows that a minimum value of 3,000 $m/s^2$ is valid in respect of an acceleration, which is the normal, centrifugal acceleration in the case of the experiment, and which can be the higher acceleration which is caused by the specific behavior of the brush elements 16 when the dirt pick-up period has passed and there is room for straightening out in an actual cleaning device 100 according to the present invention, which leaves a possibility for the normal, centrifugal acceleration during the other periods of the rotation (e.g. the dirt pick-up period) to be lower.

Even though a single brush is, according to the present invention, preferred, it is clear that also further brushes may be used without leaving the scope of the present invention.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the figures and the description, such illustration and description are to be considered illustrative or exemplary only, and not restrictive. The present invention is not limited to the disclosed embodiments.

For sake of clarity, it is noted that a fully outstretched condition of the brush elements 16 is a condition in which the brush elements 16 are fully extending in a radial direction with respect to a rotation axis 14 of the brush 12, wherein there is no bent tip portion in the brush elements 16. This condition can be realized when the brush 12 is rotating at a normal operative speed, which is a speed at which the acceleration of 3,000 $m/s^2$ at the tips 18 of the brush elements 16 can be realized. It is possible for only a portion of the brush elements 16 of a brush 12 to be in the fully outstretched condition, while another portion is not, due to obstructions which are encountered by the brush elements 16. Normally, the diameter D of the brush 12 is determined with all of the brush elements 16 in the fully outstretched condition.

The tip portions 18 of the brush elements 16 are outer portions of the brush elements 16 as seen in the radial direction, i.e. portions which are the most remote from the rotation axis 14. In particular, the tip portions 18 are the portions which are used for picking up dirt particles 22 and liquid, and which are made to slide along the surface 20 to be cleaned. In case the brush 12 is indented with respect to the surface 20, a length of the tip portion is approximately the same as the indentation.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

The invention claimed is:

1. A nozzle arrangement of a vacuum cleaning device for cleaning a surface, the nozzle arrangement comprising:

a nozzle housing;

a brush rotatable about a brush axis, said brush being provided with flexible microfiber brush elements having tip portions for contacting the surface to be cleaned and picking up dirt and liquid particles from the surface to be cleaned during the rotation of the brush, wherein the brush is at least partly surrounded by the nozzle housing and protrudes at least partly from a bottom side of said nozzle housing;

a drive means for rotating the brush;

a single squeegee element for wiping dirt and liquid particles across or off the surface to be cleaned by contacting said surface with its free end, wherein said squeegee element extends along a longitudinal direction, which is arranged substantially parallel to the brush axis, and is attached with its fixed end to the bottom side of the nozzle housing where the brush elements enter the nozzle housing during the rotation of the brush, wherein the squeegee element comprises a synthetic material with a hardness between 25 and 60 Shore-A and a force-displacement-behavior of $0.02\ N/mm<F/d<0.27\ N/mm$, wherein F is a force acting on the free end of the squeegee element perpendicular to the longitudinal direction and d is a displacement of said free end perpendicular to the longitudinal direction that is caused by the force F.

2. A nozzle arrangement as claimed in claim 1, wherein a linear mass density of a plurality of the brush elements is, at least at the tip portions, lower than 150 g per 10 km, and wherein the drive means are adapted to realize a centrifugal acceleration at the tip portions which is, in particular during a dirt release period when the brush elements are free from contact to the surface during the rotation of the brush, at least 3,000 $m/s^2$.

3. A nozzle arrangement as claimed in claim 1, wherein the synthetic material of the squeegee element has a force-displacement-behavior of $0.02\ N/mm<F/d<0.13\ N/mm$.

4. A nozzle arrangement as claimed in claim 1, wherein the squeegee element comprises a flexible rubber lip between its fixed and its free end and a plurality of protrusions for flexing the flexible rubber lip around the longitudinal direction between an open and a closed position depending on a movement direction of the nozzle arrangement, wherein said protrusions are arranged near the free end of the squeegee element and protrude from a backside of the flexible rubber lip that faces away from the brush.

5. A nozzle arrangement as claimed in claim 4, wherein the flexible rubber lip is made of polyurethane.

6. A nozzle arrangement as claimed in claim 4, wherein the flexible rubber lip has a thickness (t) of 0.5 to 3 mm.

7. A nozzle arrangement as claimed in claim 4, wherein the flexible rubber lip) has a height (h), measured between the free end and the fixed end, of 5 to 20 mm.

8. A nozzle arrangement as claimed in claim 4, wherein the protrusions force the rubber lip to flex in the open position, in which dirt and liquid particles can enter the nozzle arrangement through openings between the protrusions, the flexible rubber lip and the surface, when the nozzle arrangement is moved on the surface in a backward direction, in which the squeegee element is, seen in the movement direction, located in front of the brush, and wherein the rubber lip flexes in the closed position, in which the rubber lip is adapted to wipe dirt and liquid particles across or off the surface to be cleaned, when the nozzle arrangement is moved on the surface in a forward direction, in which the squeegee element is, seen in the movement direction, located behind the brush, wherein a contact angle ($\alpha$) between the rubber lip and the surface, measured at a contact point of the rubber lip with the surface, is in said closed position adapted to be between 35° and 50°.

9. A nozzle arrangement as claimed in claim 4, wherein a distance ($d_1$) between a front end of the protrusions that faces away from the rubber lip and the backside of the flexible rubber lip is between 0.5 and 4 mm.

10. A nozzle arrangement as claimed in claim 4, wherein a distance ($d_2$) between two of said protrusions is between 5 and 15 mm.

11. A nozzle arrangement as claimed in claim 4, wherein at least one of the protrusions comprises at least one tapered face and rounded edges.

12. A nozzle arrangement as claimed in claim 1, wherein the drive means are adapted to realize an angular velocity of the brush which is in a range of 3,000 to 15,000 revolutions per minute, more preferably in a range of 5,000 to 8,000 revolutions per minute, during operation of the device.

13. A nozzle arrangement as claimed in claim 1, wherein the brush has a diameter which is in a range of 10 to 100 mm, more preferably in a range of 20 to 80 mm, most preferably in a range of 35 to 50 mm, when the brush elements are in a fully outstretched condition, and wherein the length of the brush elements is in a range of 1 to 20 mm, preferably in a range of 8 to 12 mm, when the brush elements are in a fully outstretched condition.

14. A vacuum cleaning device for cleaning a surface, the vacuum cleaning device comprising:

a nozzle arrangement as claimed in claim 1; and a vacuum aggregate for generating an under-pressure in a suction-area between the nozzle housing and the brush.

15. A vacuum cleaning device as claimed in claim 14, wherein the vacuum aggregate is configured to generate an under-pressure in a range of 3 to 70 mbar, preferably in a range of 4 to 50 mbar, most preferably in a range of 5 to 30 mbar.

* * * * *